US005706021A

United States Patent [19]

Kurematsu

[11] Patent Number: 5,706,021

[45] Date of Patent: Jan. 6, 1998

[54] LIQUID CRYSTAL DISPLAY

[75] Inventor: Katsumi Kurematsu, Kawasaki, Japan

[73] Assignee: Canon Kabushiki Kaisha, Tokyo, Japan

[21] Appl. No.: 387,629

[22] Filed: Feb. 13, 1995

Related U.S. Application Data

[63] Continuation of Ser. No. 34,828, Mar. 18, 1993, abandoned.

[30] Foreign Application Priority Data

Mar. 19, 1992 [JP] Japan ..... 4-092302

[51] Int. Cl.[6] ..... G09G 3/36

[52] U.S. Cl. ..... 345/89; 345/103; 345/149; 349/85; 349/144

[58] Field of Search ..... 340/784; 359/87, 359/59, 84, 88, 54, 56; 345/88, 89, 90, 103, 149, 147; 349/85, 144

[56] References Cited

U.S. PATENT DOCUMENTS 4,712,877 12/1987 Okada et al. ..... 340/793
4,981,340 1/1991 Kurematsu et al. ..... 350/333
4,990,905 2/1991 Kujik ..... 340/784
5,126,865 6/1992 Sarma ..... 345/103
5,296,870 3/1994 Nicholas ..... 345/89

FOREIGN PATENT DOCUMENTS 63-316025 12/1988 Japan .

*Primary Examiner*—Richard Hjerpe
*Assistant Examiner*—Kara Farnandez Stoll
*Attorney, Agent, or Firm*—Fitzpatrick, Cella, Harper & Scinto

[57] ABSTRACT

A liquid crystal display apparatus for a matrix display is constituted by a plurality of data electrodes, a plurality of scanning electrodes disposed opposite to and intersecting the data electrodes so as to form a pixel at each overlapping of the data electrodes and scanning electrodes, a liquid crystal layer disposed between the data electrodes and scanning electrodes, and plural gradation electrodes disposed at each pixel. The gradation electrodes are capacitively coupled to each other and capacitively or electrically coupled to an associated one of the scanning electrodes and data electrodes so as to apply stepwise different voltages across the liquid crystal layer between the gradation electrodes and an opposite one of the data electrodes and scanning electrodes.

8 Claims, 19 Drawing Sheets

LIQUID CRYSTAL DISPLAY

This application is a continuation of application Ser. No. 08/034,828 filed Mar. 18, 1993, now abandoned

FIELD OF THE INVENTION AND RELATED ART

The present invention relates to a liquid crystal apparatus using a liquid crystal, such as STN (super-twisted nematic) liquid crystal, or a liquid crystal having a memory characteristic, such as an FLC (ferroelectric liquid crystal) and utilizing capacitance division of applied voltages to effect gradational (gray-scale) display.

Such a type of gradational display apparatus has been already disclosed in Japanese Laid-Open Patent Application (JP-A) 63-316025. FIG. 20A and FIG. 20B show a sectional structure and an equivalent circuit of such an apparatus. In the apparatus, a plurality of discrete intermediate electrodes 56 electrically isolated from each other are disposed within one pixel defined by an intersection of a scanning electrode 51 and a data electrode 52 so that ratios of capacitances $C_1$–$C_5$ formed between the respective intermediate electrodes 56 and the data electrodes 52 to capacitances $C_{L1}$–$C_{L5}$ formed between the respective intermediate electrodes 56 and the scanning electrode 51 with a liquid crystal 21 disposed therebetween are changed stepwise, and a display voltage pulse applied between the data electrode 52 and the scanning electrode 51 is capacitively divided according to the ratios to apply stepwise different voltages to the liquid crystal layer below the respective intermediate electrodes 56. As a result, in response to application of a certain display voltage pulse, liquid crystal molecules at all the parts below the intermediate electrodes 56 where voltages exceeding a threshold voltage Vth of the liquid crystal 21 change their orientations to modulate optical transmittances at different degrees, whereby a stepwise voltage-area gradational display is produced corresponding to the number of the intermediate electrodes 56 per pixel.

In the above prior-art apparatus, however, for an intermediate electrode 56 providing a low division voltage to the liquid crystal layer 21, the capacitance between the intermediate electrode 56 and the data electrode 52 becomes considerably smaller than the capacitance between the intermediate electrode 56 and the scanning electrode 51 sandwiching the liquid crystal layer 21. Accordingly, in the case where a liquid crystal having a spontaneous polarization Ps, such as an FLC, is used as the liquid crystal 21, a quantity of charge sufficient to cause an inversion of the spontaneous polarization Ps cannot be supplied from a small capacitance between the intermediate electrode 56 and the data electrode 52, so that there is encountered a difficulty that the liquid crystal molecules cannot be moved sufficiently even if a voltage exceeding the threshold voltage Vth is applied to the liquid crystal layer 21.

SUMMARY OF THE INVENTION

An object of the present invention is to provide a liquid crystal apparatus, particularly a liquid crystal apparatus using FLC, suitable for gradational display.

According to the present invention, there is provided a liquid crystal apparatus, comprising: a plurality of first electrodes, a plurality of second electrodes disposed opposite to and intersecting the first electrodes so as to form a pixel at each intersection of the first and second electrodes, a liquid crystal layer disposed between the first electrodes and the second electrodes, and a plurality of third electrodes disposed at each pixel, wherein the third electrodes are capacitively coupled to each other and capacitively or electrically coupled to an associated one of the first electrodes so that stepwise different voltages are applied across the liquid crystal layer between the third electrodes and an opposite one of the second electrodes.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Figure 1:
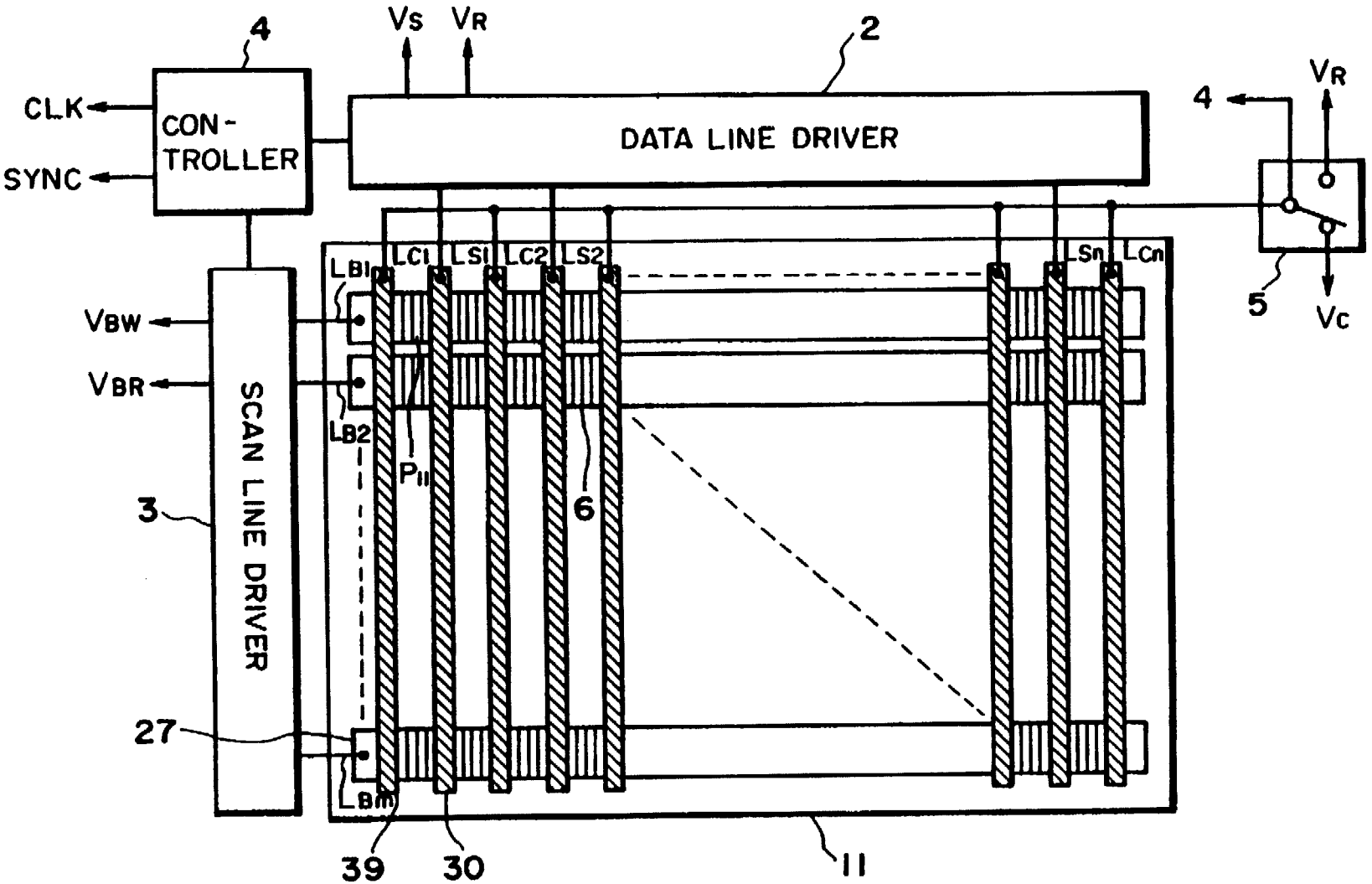
FIG. 1 is an overall plan view of a liquid crystal display apparatus according to an embodiment of the invention.

In a preferred embodiment, the liquid crystal apparatus is constituted as a display apparatus for a matrix display, including a plurality of data electrodes, a plurality of scanning electrodes disposed opposite to and intersecting overlapping the data electrodes so as to form a pixel at each intersection of the data electrodes and scanning electrodes, a liquid crystal layer disposed between the data electrodes and the scanning electrodes, and plural gradation electrodes disposed at each pixel for application of stepwise different voltages to the liquid crystal layer between the gradation electrodes and an opposite one of the data electrodes and the scanning electrodes, the gradation electrodes being capacitively coupled to each other and capacitively or electrically coupled to an associated (not opposite) one of the scanning electrodes and data electrodes, thereby to apply the above-mentioned stepwise different voltages.

Herein, it is also possible to further dispose a plurality of auxiliary data electrodes each between adjacent two data electrodes so that the gradation electrodes are disposed between an adjacent pair of a data electrode and an auxiliary data electrode to effect a capacitance division of the potential difference between the data electrode and the auxiliary data electrode. In this instance, with respect to the gradation electrodes corresponding to one pixel, it is preferred that a capacitance between adjacent gradation electrodes is larger than a capacitance between each gradation electrode and the opposite scanning electrode or data electrode. Further, with respect to the gradation electrodes corresponding to one pixel, the capacitances between adjacent pairs of gradation electrodes may preferably be mutually different, so that the voltages between the respective gradation electrodes and the opposite scanning electrode or data electrode are linearly distributed within one pixel. Adjacent gradation electrodes may partially overlap with each other with an insulating film therebetween or may be disposed on the same plane with a minute gap therebetween.

In the above-described construction, when a writing data voltage and a scanning selection signal are applied to a data electrode and a scanning electrode corresponding to a pixel, the voltage applied to the data electrode or scanning electrode is sequentially and serially transferred to the gradation electrodes capacitively coupled to each other through the closest one of the gradational electrodes coupled capacitively or electrically to the data electrode or scanning electrode, thereby developing stepwise different voltages at the respective gradation electrodes. As a result, between the respective gradation electrodes and the opposite scanning electrode or data electrode, stepwise different electric fields are generated and applied across the liquid crystal layer to drive the liquid crystal at the pixel corresponding to the applied voltage, thus given gradation data. In this instance, if the capacitance between adjacent gradation electrodes is set to be sufficiently large, a sufficient charge is supplied even to a gradation electrode receiving a low voltage. As a result, if the applied voltage exceeds an inversion threshold voltage of a liquid crystal, the liquid crystal molecules are sufficiently driven to ensure a reliable gradational drive even for a liquid crystal having a spontaneous polarization, such as a ferroelectric liquid crystal.

EXAMPLE 1

FIG. 1 is a diagrammatic view of a liquid crystal display apparatus according to a first embodiment of the present invention. The apparatus includes a controller 4 for controlling a scanning line driver 3, an auxiliary data line driver switch 5 and a data line driver 2, by which are respectively driven scanning electrodes 27 ($L_{B1}$–$L_{Bm}$), auxiliary data electrodes 39 ($L_{C1}$–$L_{Cn}$) and data electrodes 30 ($L_{S1}$–$L_{SN}$) in a panel 11. Between the respective auxiliary data electrodes 39 and the data electrodes 30, gradation electrodes 6 are disposed on the same substrate, while scanning electrodes 27 are disposed on a different substrate oppositely disposed with a liquid crystal therebetween. The liquid crystal, an FLC (ferroelectric liquid crystal) in this example, is driven by voltages between the scanning electrodes 27 and the gradation electrodes 6.

Figure 2A:
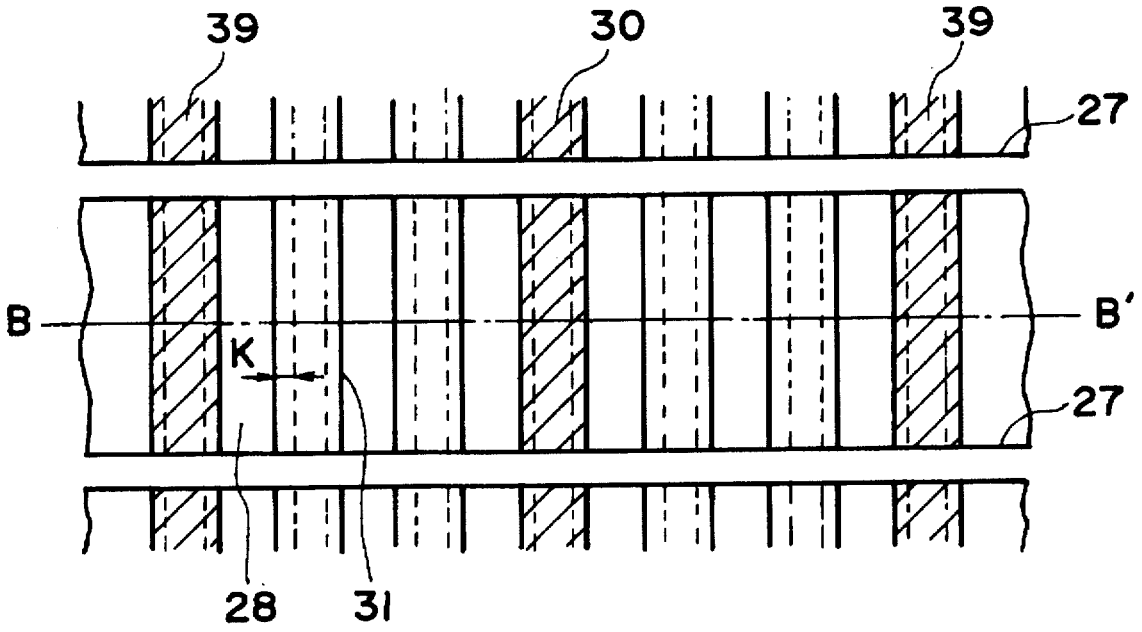
FIGS. 2A and 2B are an enlarged plan view and a sectional view, respectively, of a part corresponding to one pixel in the apparatus shown in FIG. 1.
Figure 2B:
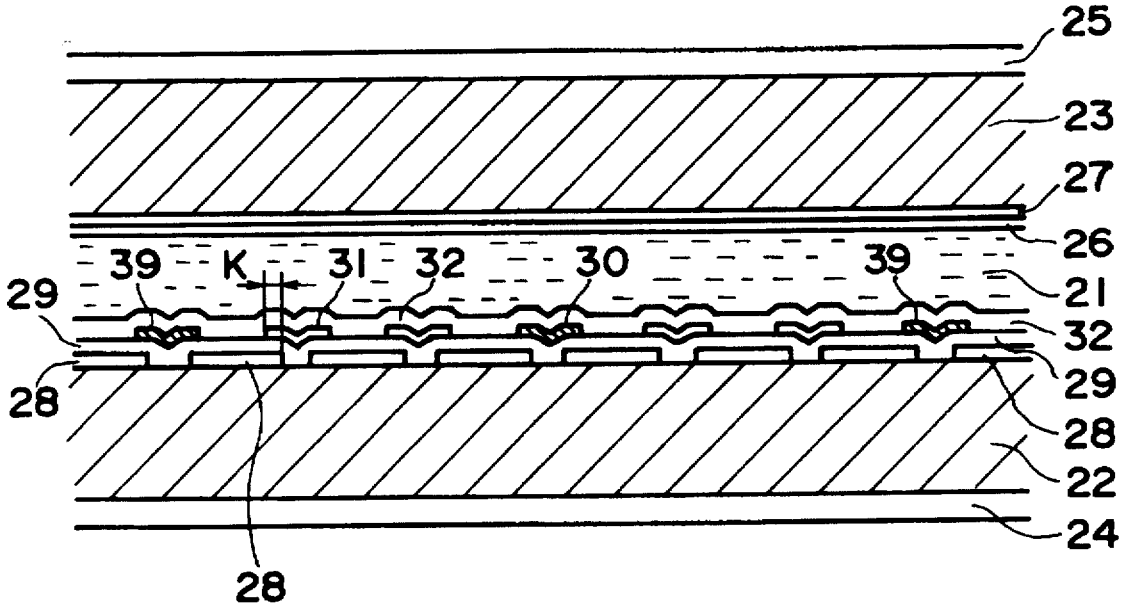

FIG. 2A is an enlarged plan view of a part corresponding to one pixel in the apparatus, and FIG. 2B is a sectional view taken along the line B–B' in FIG. 2A. Referring to these figures, between a data electrode 30 and auxiliary data electrodes 39, electrode stripes 28 and 31 constituting gradation electrodes 6 are disposed alternately in a lower layer and in an upper layer, respectively, and in a state of being mutually electrically isolated from each other. In a specific example, the panel was produced in the following process.

(1) Gradation electrode stripes 28 of 1000Å-thick ITO were formed by sputtering and photolithography on a glass substrate 22. (2) A 1000Å-thick insulating film 29 of $SiO_2$ was formed thereon by sputtering. (3) Gradation electrode stripes 31 of 1000Å-thick ITO were formed thereon by sputtering and photolithography. Then, (4) data electrode stripes 30 and auxiliary data electrode stripes 39 respectively of 1000Å-thick A1 were formed by evaporation and photolithography. Then, (5) an alignment film 32 of a polyimide ("LP-64", available from Toray K.K.) was formed thereon by spin-coating and baking, followed by rubbing.

On the other hand, on a glass substrate 23, (6) scanning electrodes 27 of 1000Å-thick ITO stripes were first formed by sputtering and photolithography. Then, (7) an alignment film 26 of a polyimide ("LP-64") was formed by spin-coating and baking, followed by rubbing. The rubbing direction was so selected that it intersected at an angle of 10 degrees with the rubbing direction on the substrate 22 in the step (5) when the substrates 22 and 23 were assembled to form a cell thereafter.

Then, (8) the substrate 22 after the steps (1)–(5) and the substrate 23 after the steps (6)–(7) were applied to each other with a spacer therebetween to form a cell. Then, (9) the cell was filled with a liquid crystal 21 (FLC) and sealed up, followed by application of polarizing plates 24 and 25. The liquid crystal was one showing the following phase-transition series and properties.

$$\text{Iso.} \underset{84.9^\circ\text{ C.}}{\overset{85.4^\circ\text{ C.}}{\rightleftharpoons}} \text{Ch.} \underset{72.6^\circ\text{ C.}}{\overset{71.2^\circ\text{ C.}}{\rightleftharpoons}} \text{SmA} \underset{59.4^\circ\text{ C.}}{\overset{58.5^\circ\text{ C.}}{\rightleftharpoons}} \text{SmC*} \underset{-18.1^\circ\text{ C.}}{\overset{-23.5^\circ\text{ C.}}{\rightleftharpoons}} \text{Cryst.}$$

$Ps=6.2\ nC/cm^2$ (at 30° C.)

Tilt angle=22 degrees (at 20° C.)

$\Delta\epsilon=-0.1$ (at 30° C.)

In this embodiment, the upper gradation electrode stripes 31 and lower gradation electrode stripes 28 were disposed with an overlapping width of k by the medium of the insulating film 29, so that adjacent gradation electrodes were coupled to each other with a capacitance formed at the overlapping. Similarly, the lower gradation electrode stripes 28 were disposed so as to overlap with the data electrode stripes 30 and the auxiliary data electrode stripes 39.

Figure 3A:
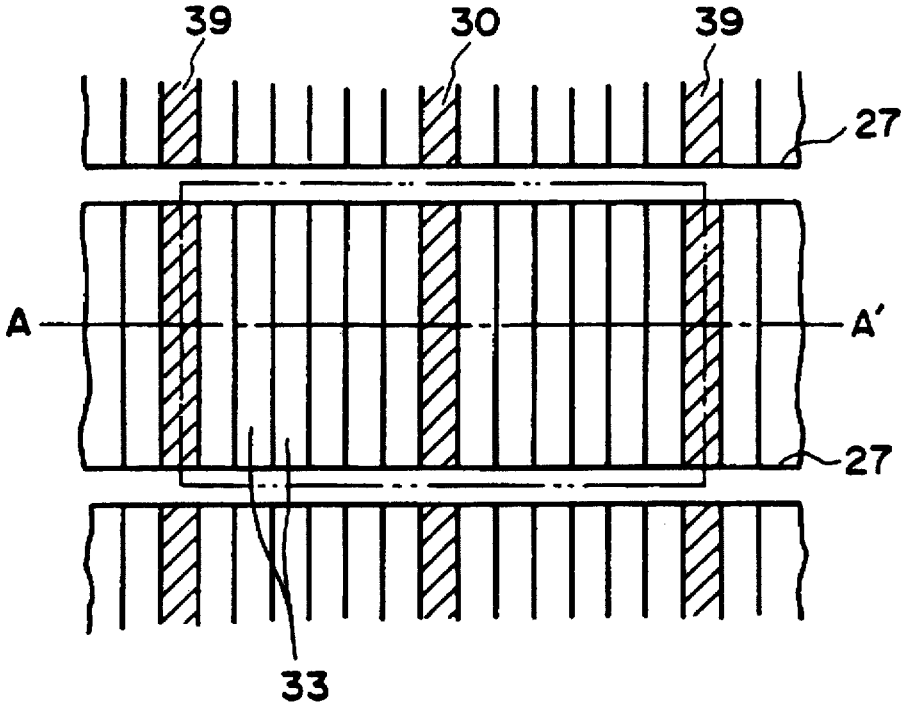
FIGS. 3A and 3B are an enlarged plan view and a sectional view, respectively, of a part corresponding to one pixel in the apparatus shown in FIG. 1 having a different arrangement of gradation electrodes.
Figure 3B:
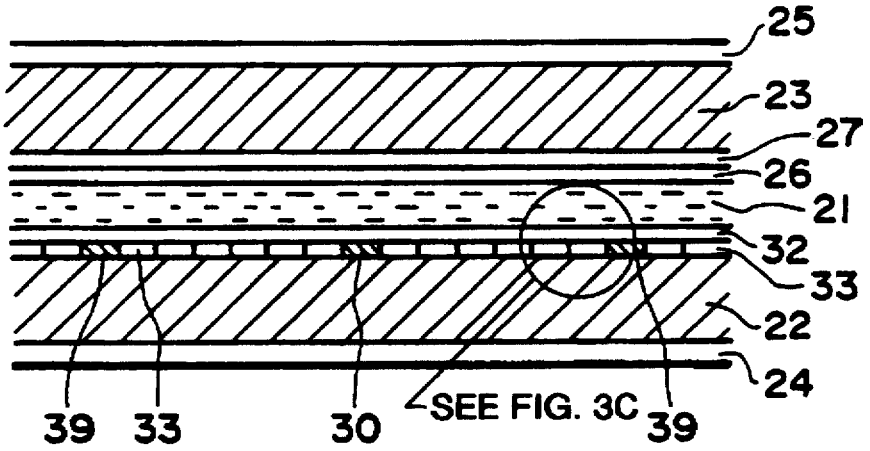
Figure 3C:
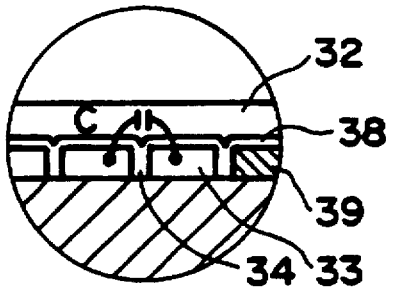
FIG. 3C is an enlarged view of a part in FIG. 3B.

FIG. 3A is an enlarged plan view of a part corresponding to one pixel in the apparatus shown in FIG. 1 according to another embodiment having a different arrangement of gradation electrodes 6. FIG. 3B is a sectional view taken along the line A–A' in FIG. 3A, and FIG. 3C is a partially enlarged view of FIG. 3B. In this embodiment, gradation electrode stripes 33 constituting the gradation electrodes 6 are arranged with a minute gap 34 therebetween so as to fill a spacing between a data electrode 30 and an auxiliary data electrode 39 on a glass substrate 22. On the electrodes, an insulating film 38 also filling the minute gaps 34 and an alignment film 32 are formed thereon. The other structures are similar to those in the embodiment of FIGS. 2A and 2B. In this embodiment, a minute gap 34 filled with an insulating material of the insulating layer 38 constitutes a capacitance between adjacent gradation electrodes 33, and the gradation electrodes 33 are coupled to each other with such a capacitance. Also, the gradation electrodes 33 are coupled to a data electrode 30 and an auxiliary data electrode 39.

Figure 2C:
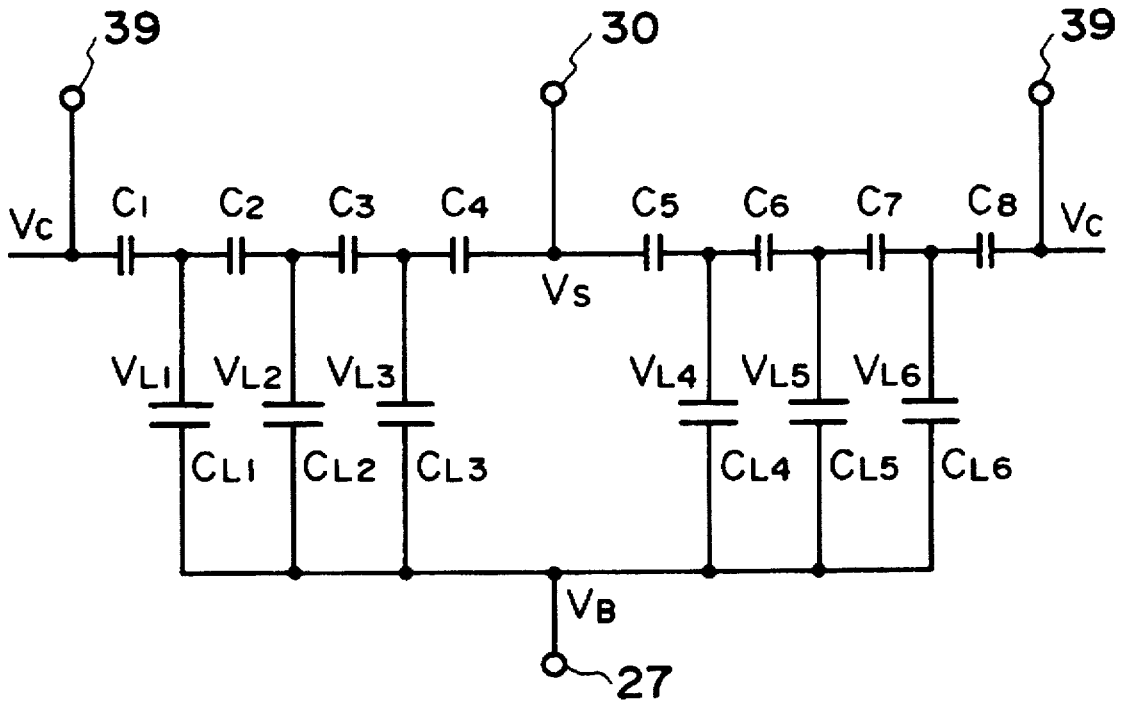
FIG. 2C is an equivalent circuit diagram of the part shown in FIGS. 2A and 2B.
Figure 4:
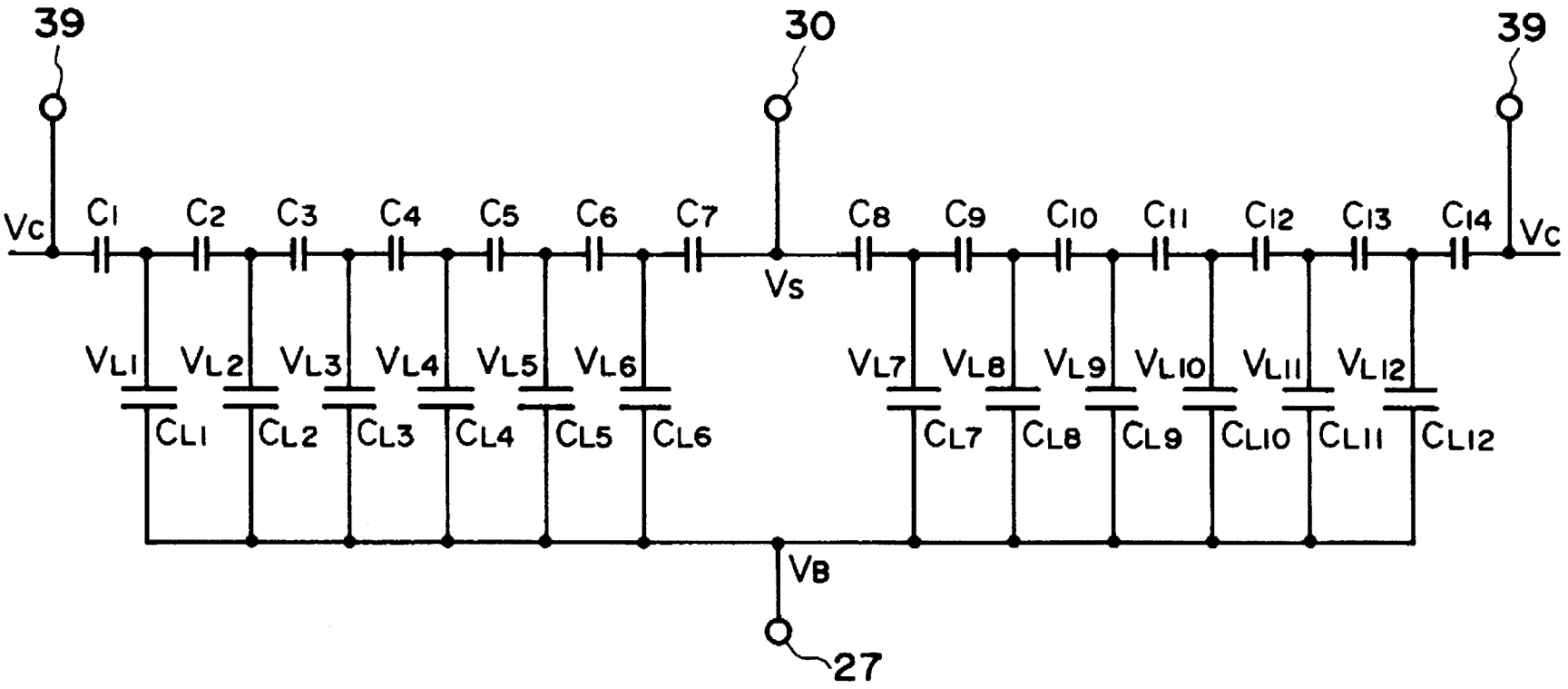
FIG. 4 is an equivalent circuit diagram of the part shown in FIG. 3A and 3B.

The arrangement of the gradation electrodes 6 can be either as shown in FIGS. 2A and 2B or as shown in FIGS. 3A–3C. An equivalent circuit of one pixel shown in FIGS. 2A and 2B is represented by FIG. 2C, and an equivalent circuit of one pixel shown in FIGS. 3A–3C is represented by FIG. 4, wherein $V_S$ denotes a data voltage; $V_C$, an auxiliary data voltage, $V_B$, a scanning voltage; $C_1$–$C_{14}$, respectively, a capacitance between adjacent gradation electrodes, or a capacitance between a gradation electrode and a data electrode 30 or auxiliary data electrode 39 adjacent thereto; $C_{L1}$–$C_{L12}$, respectively, a capacitance between a gradation electrode and a scanning electrode 27 sandwiching the liquid crystal layer; and $V_{L1}$–$VL_{12}$, voltages applied to the respective gradation electrodes.

Figure 2D:
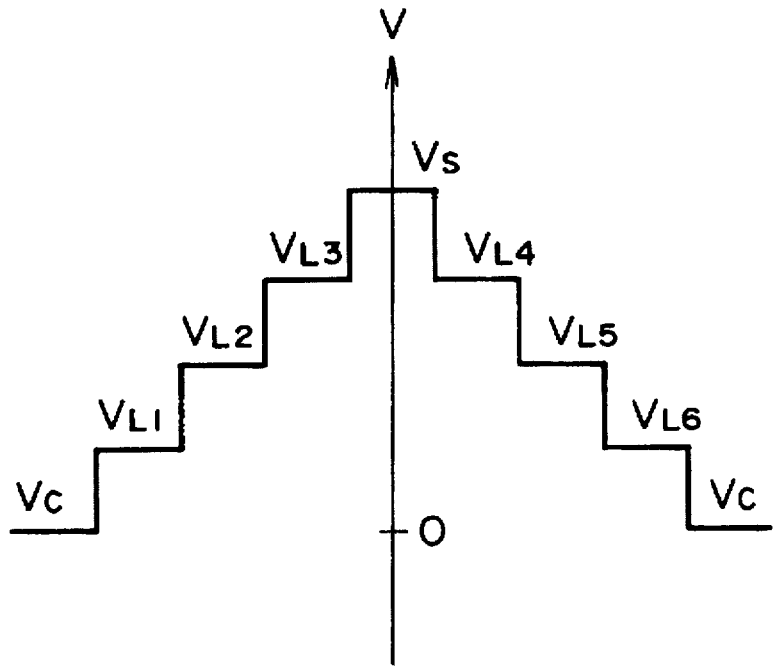
FIG. 2D is a diagram showing a voltage distribution provided to the gradation electrodes in the same part.
Figure 5:
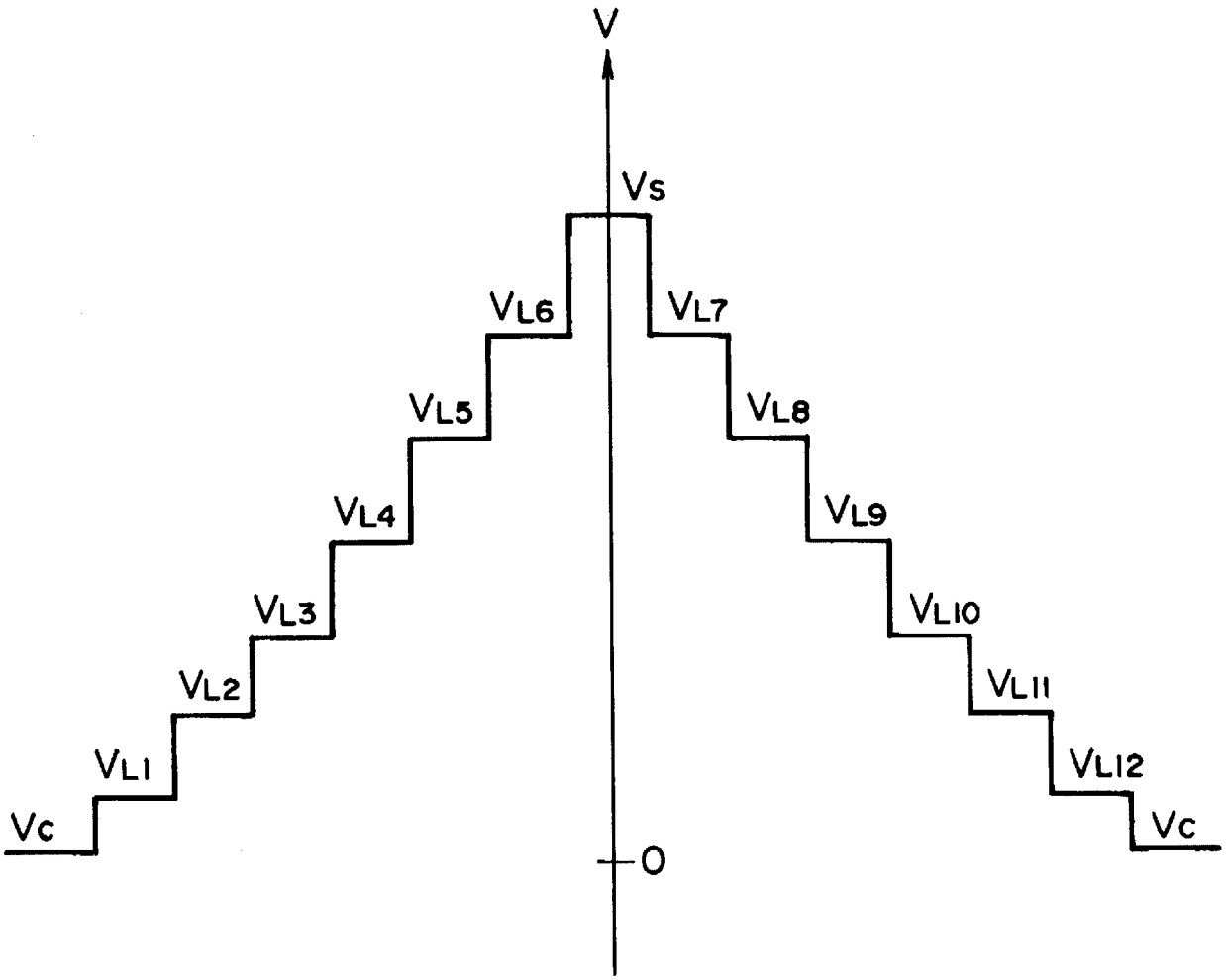
FIG. 5 is diagram showing a voltage distribution provided to the gradation electrodes in the part shown in FIGS. 3A and 3B.

In case where $C_{L1}$–$C_{L12}$ are all 0.2 pF (corresponding to a gradation electrode size of 200 μm×50 μm, and an FLC layer thickness of 1.4 μm), capacitances $C_1$–$C_{14}$ are all 1.0 pF (corresponding to an overlapping width k of 15 μm in the embodiment shown in FIG. 2), and the data electrode 30, auxiliary data electrode 39 and scanning electrode 27 are all held at 0 volt, a voltage distribution at the respective gradation electrodes as shown in FIG. 2D corresponding to FIG. 2C and a voltage distribution of $V_{L1}$–$V_{L12}$ at the respective gradation electrodes as shown in FIG. 5 corresponding to FIG. 4 are developed instantaneously due to capacitance division when a data pulse of voltage $V_S$ is applied to the data electrode 30. As a result, stepwise different voltage levels are applied to the liquid crystal layer on the respective gradation electrodes. Accordingly, in response to application of a data voltage pulse, the liquid crystal on all the gradation electrodes within one pixel giving voltages exceeding a threshold voltage Vth changes its molecular orientation to modulate the optical transmittance, wherein stepwise voltage-area gradational display can be effected corresponding to the number of gradation electrodes within one pixel.

In the above embodiment, however, as is understood from, e.g., FIG. 5, the voltage distribution of $V_{L1}$–$V_{L12}$ is not linear. Further, the voltage distribution is symmetrical with respect to the data electrode 30 as the center, so that the number of gradation levels is reduced to a half of the number of gradation electrodes (12 in the case of FIG. 5).

Figure 6:
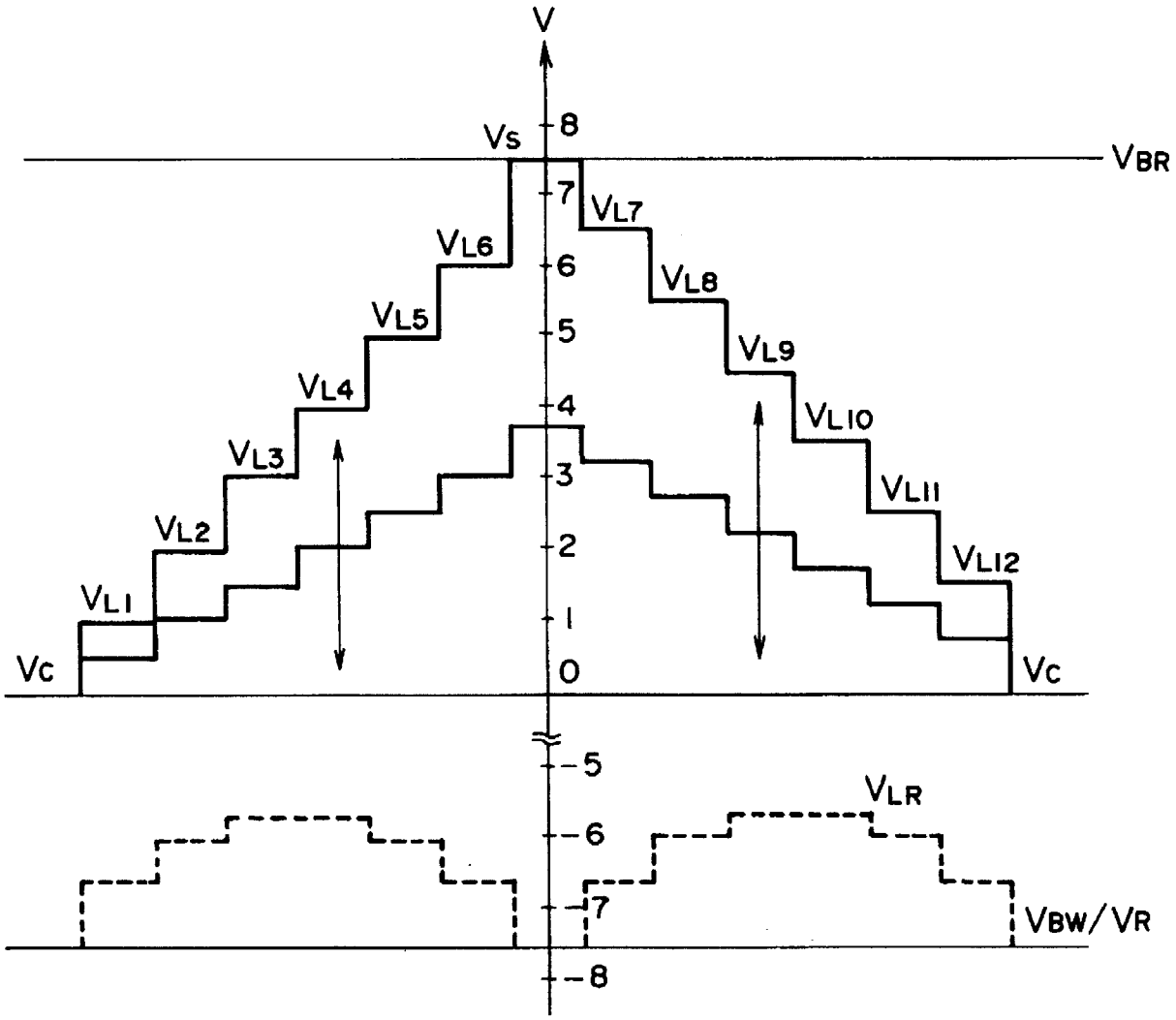
FIG. 6 is diagram showing another voltage distribution provided to the gradation electrodes in the apparatus shown in FIG. 1.

FIG. 6 is a diagram showing an example of improved voltage distribution wherein the distribution is made unsymmetrical with respect to the data electrode 30 as the center and is provided with a linearity by optimization of the capacitances $C_1$–$C_{12}$. The optimization of the capacitance $C_1$–$C_{12}$ may be performed by adjusting the overlapping width (or area) k in the embodiment of FIG. 2 or by adjusting the minute gap 34 in the embodiment of FIG. 3. As a result, the voltages $V_{L1}$–$V_{L12}$ can be made all different to allow 12 levels of gradational display. Herein, the data pulse voltage $V_S$ can vary from 0 volt to 7.5 volts, whereby the voltages $V_{L1}$–$V_{L12}$ can vary as indicated by arrows as shown in FIG. 6 while retaining the unsymmetricity and linearity. In FIG. 6, $V_{BR}$ and $V_{BW}$ denote scanning voltages (voltages applied to a scanning electrode 27) at the time of resetting and writing, respectively, and $V_R$ denotes a data voltage and an auxiliary data voltage at the time of resetting (a resetting voltage applied to a data electrode 30 and an auxiliary data electrode 39). In the figure, $V_{LR}$ indicated by dashed lines represents voltages of the respective gradation electrodes at the time of resetting.

Figure 7:
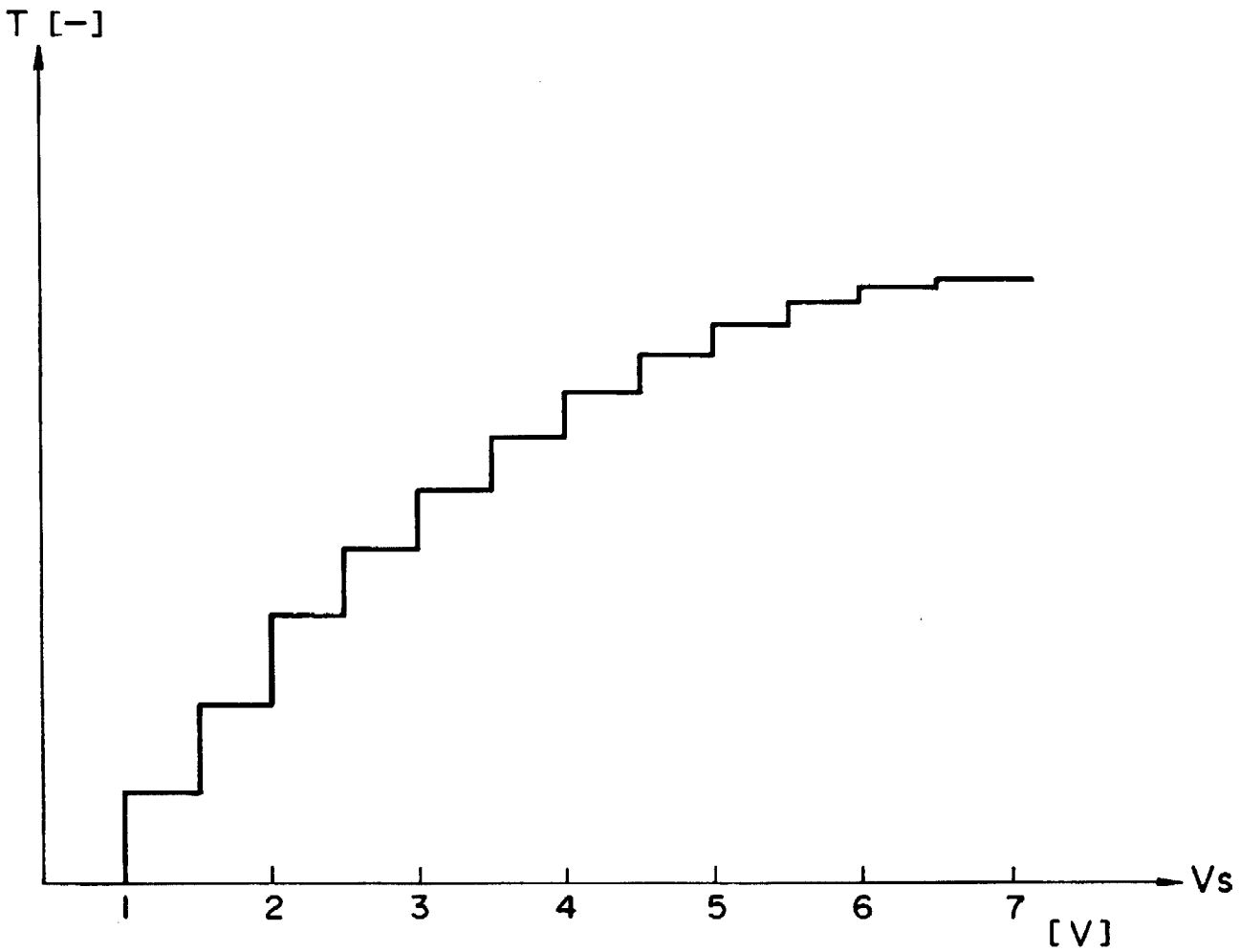
FIG. 7 is a graph showing a relationship (V–T curve) between the data pulse voltage $V_S$ and the transmittance through the liquid crystal cell in the apparatus of FIG. 1.

FIG. 7 is a graph showing a relationship (V–T curve) between the data pulse voltages and the transmittance of a liquid crystal cell in this case, thus indicating that a good gradation characteristic is obtained thereby.

Figure 8:
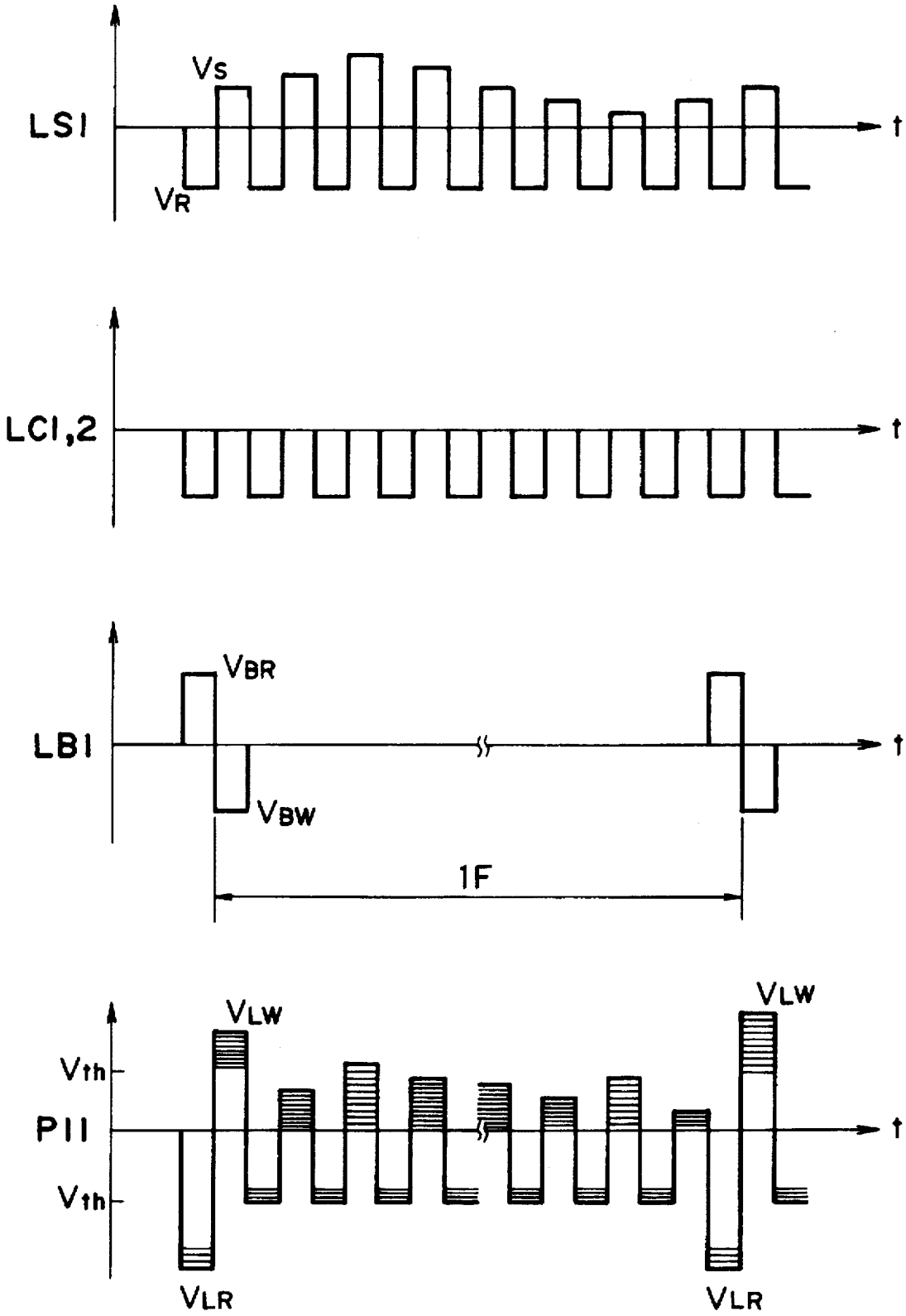
FIG. 8 is a waveform diagram showing voltage waveforms applied to the respective electrodes in the apparatus of FIG. 1.

FIG. 8 shows voltage waveforms LS1, LC1,2, and LB1 applied to a data electrode $L_{S1}$, auxiliary data electrodes $L_{C1}$ and $L_{C2}$ and a scanning electrode $L_{B1}$, respectively, and a voltage waveform P11 applied to the liquid crystal at a pixel $P_{11}$ (see FIG. 1) disposed at the intersection of the data electrode $L_{S1}$ and the scanning electrode $L_{B1}$. These voltage pulses all have a pulse width of 100 μsec. At a time when a reset voltage pulse $V_R$ of the waveforms LS1 and LC1,2 and a reset voltage pulse $V_{BR}$ of the waveform LB1 are synchronized, the liquid crystal at the pixel $P_{11}$ is reset by application of a voltage pulse $V_{LR}$ (see FIG. 6) exceeding a threshold Vth. Immediately thereafter, at a time when a data voltage pulse $V_S$ of the waveform LS1 and a writing voltage pulse $V_{BW}$ of the waveform LB1 are synchronized, a voltage pulse $V_{LW}$ including the above-mentioned voltages $V_{L1}$–$V_{L12}$ is applied to the pixel $P_{11}$ to effect a writing (gradational display). The pixel receives crosstalk voltages until a subsequent resetting and writing after one frame of writing due to application of data voltages to pixels on the other scanning lines, but adverse effects thereof can be obviated by setting these crosstalk voltages to be below the threshold voltage Vth of the liquid crystal.

In the above embodiment, there is set a relationship of capacitances $C_1$ to $C_{14}$>>$C_{L1}$ to $C_{L12}$ and such a relationship can be structurally easily established, so that quantities of charges required for inversion of the spontaneous polarization $P_S$ of FLC are sufficiently supplied from the capacitances $C_1$–$C_{14}$ to the capacitances $C_{L1}$–$C_{L14}$, thereby allowing a good drive of FLC.

The insulating films 29 and 38 were composed of $SiO_2$ in a specific example as described above but can be composed of another material. It is rather preferred to use a material having a higher dielectric constant, such as $Si_3N_4$ or $Ta_2O_5$. Further, prior to the above-mentioned steps (5) and (7) of forming alignment control films during the above-mentioned panel production process, it is preferred to form an insulating film (passivation) of $Ta_2O_5$, $SiO_2$, etc., on the entire substrate by sputtering, for example, so as to prevent short circuit between the pair of substrates.

The above modifications regarding the insulating film materials and passivation can also be applicable to the following examples.

EXAMPLE 2

Figure 9:
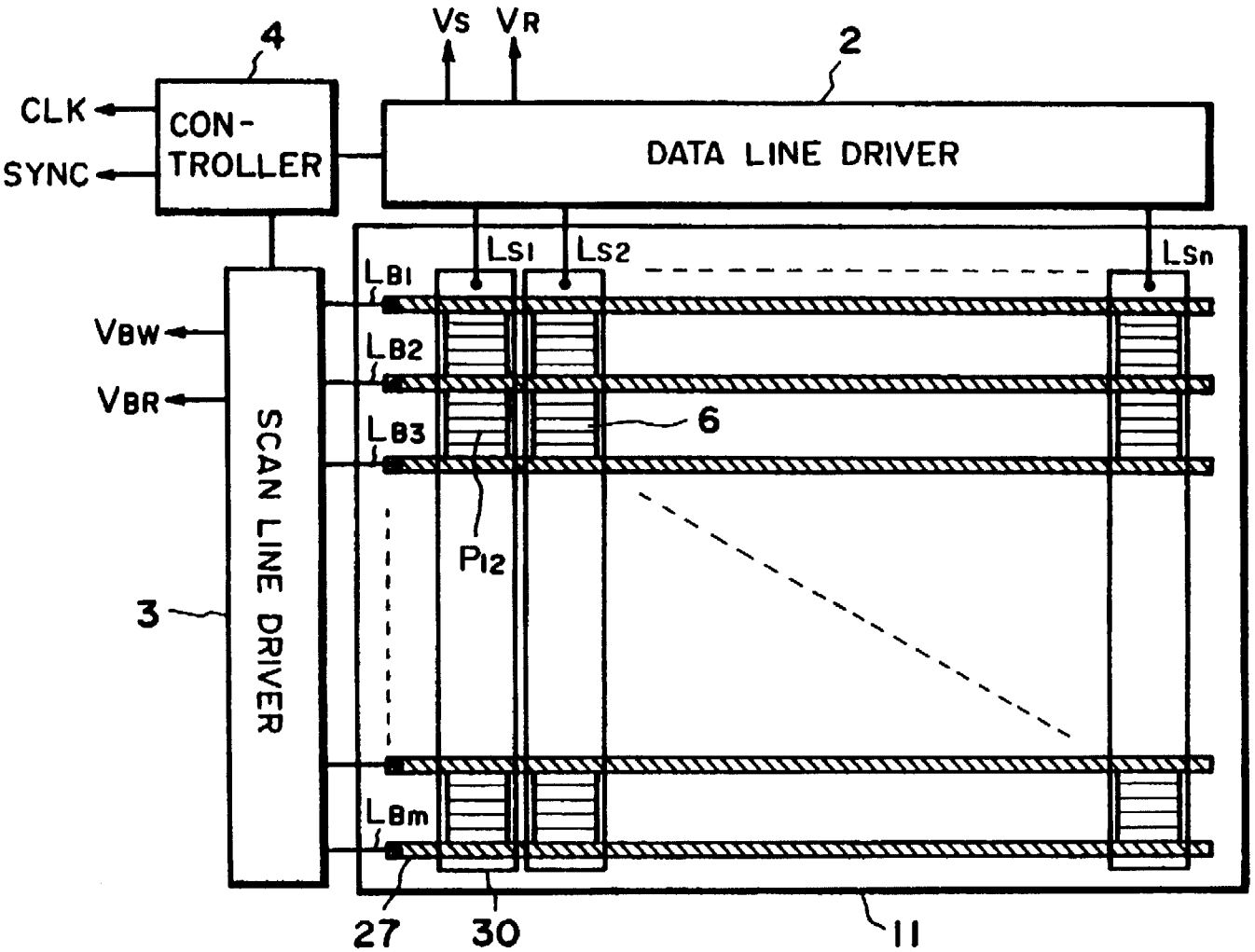
FIG. 9 is an overall plan view of a liquid crystal display apparatus according to a second embodiment of the invention.

FIG. 9 is an overall diagrammatic view of a liquid crystal apparatus according to a second embodiment of the present invention. Referring to the figure, the apparatus includes a controller 4 for controlling a scanning line driver 3 and a data line driver 2, by which are respectively driven scanning electrodes 27 ($L_{B1}$–$L_{Bm}$) and data electrodes 30 ($L_{S1}$–$L_{SN}$) in a panel 11. Between the respective scanning electrodes 27, gradation electrodes 6 are disposed on the same substrate, while data electrodes 30 are disposed on a different substrate oppositely disposed with a liquid crystal therebetween. The liquid crystal is driven by voltages between the data electrodes 30 and the gradation electrodes 6.

This example is particularly different from Example 1 in that the gradation electrodes are disposed in electrical isolation from each other between the scanning electrodes 27, and the other cell structure and production process are similar to those in Example 1. The liquid crystal may similarly comprise FLC.

Figure 10:
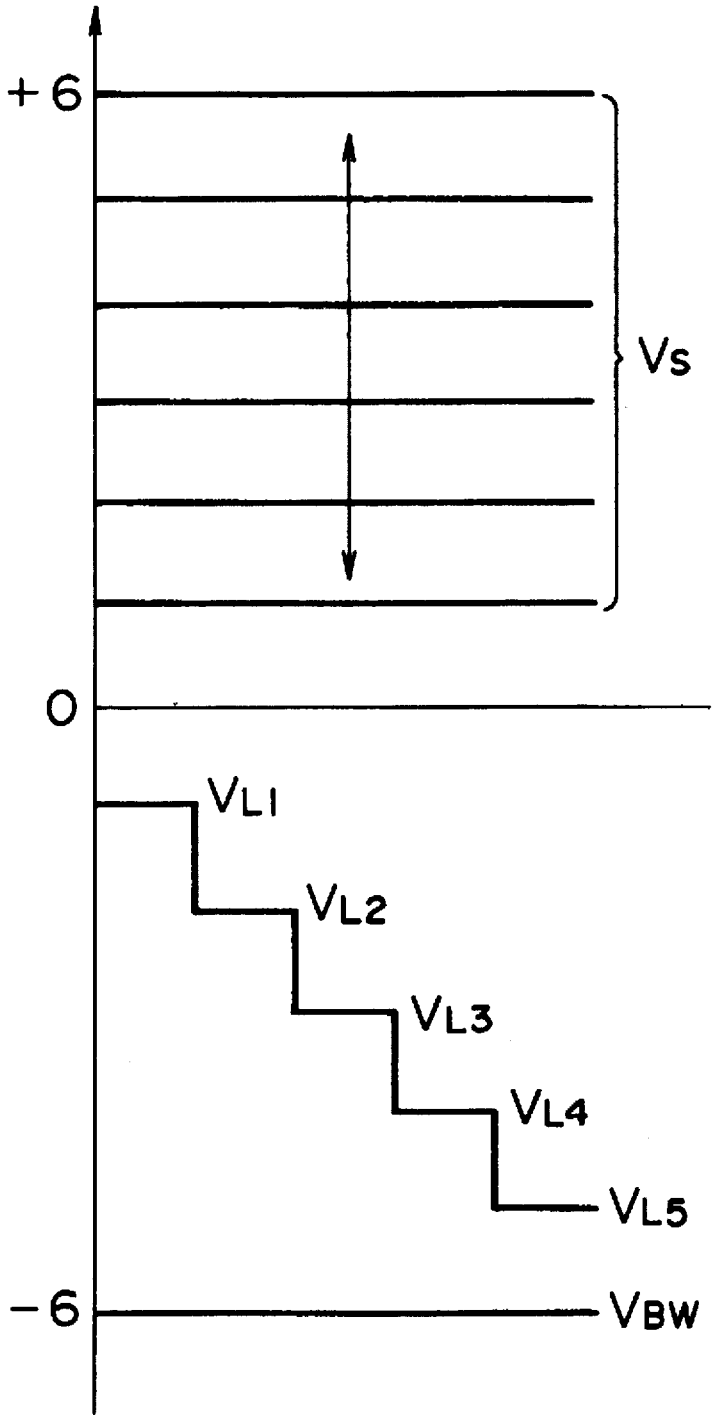
FIG. 10 is diagram showing a voltage distribution provided to the gradation electrodes in one pixel of the apparatus shown in FIG. 9.

FIG. 10 shows a voltage distribution at respective gradation electrodes 6 in one pixel at the time of selection. Herein, one pixel is constituted by gradation electrodes 6 sandwiched between two adjacent scanning electrodes 27. For example, referring to FIG. 9, gradation electrodes 6 sandwiched between scanning electrodes $L_{B2}$ and $L_{B3}$ and disposed opposite to a data electrode $L_{S1}$ correspond to a pixel $P_{12}$. When a pixel is sandwiched between two scanning electrodes 27, one of which receives 0 volt and the other of which receives −6 volts ($V_{BW}$), a line of pixels including the pixels are selected. In this instance, the voltages of the gradation electrodes at the pixel are capacitively divided into voltages $V_{L1}$–$V_{L5}$ which may vary stepwise as shown in FIG. 10.

On the other hand, data electrodes 30 are supplied with various levels of data voltages $V_S$ as shown in FIG. 10. As a result, the liquid crystal can change its molecular orientation at selective gradation electrodes where the liquid crystal receive voltage differences between a data voltage $V_S$ and voltages $V_{L1}$–$V_{L5}$ exceeding the threshold voltage Vth of the liquid crystal, thereby effecting modulation of the optical transmittance therethrough. As a result, a stepwise voltage-area gradational display can be effected at a number of levels (5 levels in this embodiment) corresponding to the number of gradation electrodes in one pixel. Further, in this embodiment, the voltage distribution among the gradation electrodes is constant regardless of the level of the data voltage $V_S$, so that it is possible to obtain a V–T curve with a better linearity than in the previous example (shown in FIG. 7).

Figure 11:
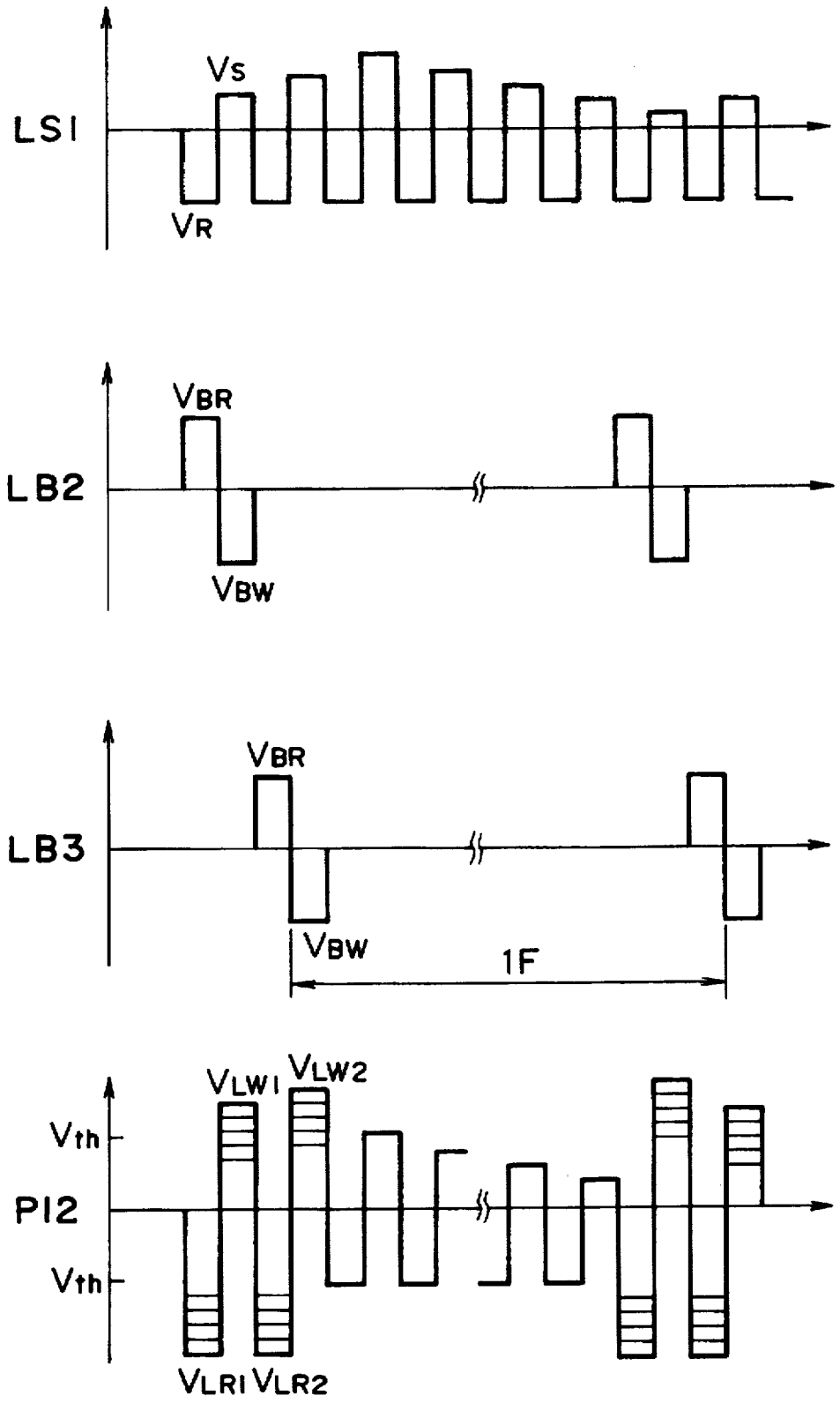
FIG. 11 is a waveform diagram showing voltage waveforms applied to the respective electrodes in the apparatus of FIG. 9.

FIG. 11 shows voltage waveforms LS1, LB2 and LB3 applied to a data electrode $L_{S1}$, a scanning electrode $L_{B2}$ and a scanning electrode $L_{B3}$, respectively, and a voltage waveform P12 applied to a pixel $P_{12}$ disposed at an intersection of the data electrode $L_{S1}$ and the spacing between the scanning electrodes $L_{B2}$ and $L_{B3}$. These voltage pulses all have a pulse width of 100 μsec. At a time when a reset voltage pulse $V_R$ of the waveform LS1 and a reset voltage pulse $V_{BR}$ of the waveform LB3 are synchronized, the liquid crystal at the pixel $P_{12}$ is reset by application of a voltage pulse $V_{LR2}$ exceeding a threshold Vth. Immediately thereafter, at a time when a data voltage pulse $V_S$ of the waveform LS1 and a writing voltage pulse $V_{BW}$ of the waveform LB3 are synchronized, a voltage pulse $V_{LW2}$ including the above-mentioned voltages $V_{L1}$–$V_{L5}$ is applied to the pixel $P_{12}$ to effect a writing (gradational display). The pixel receives crosstalk voltages until a subsequent resetting and writing after one frame of writing due to application of data voltages to pixels on the other scanning lines, but adverse effects thereof can be obviated by setting these crosstalk voltages to be below the threshold voltage Vth of the liquid crystal.

On the other hand, voltages exceeding the threshold voltage ($V_{LR1}$ and $V_{LW1}$ in FIG. 11) can enter the pixel $P_{12}$ as a crosstalk by resetting and writing in the pixels on a previous scanning line (more exactly a spacing between two scanning electrodes $L_{B1}$ and $L_{B2}$), but this does not substantially adversely affect the display of the pixel $P_{12}$ since the pixel $P_{12}$ is reset and written by its own display data immediately thereafter.

In this embodiment (Example 2), it is not only possible to effect a smooth drive of FLC similarly as in Example 1 but also possible to adopt a simpler electrode arrangement since the auxiliary data electrodes can be omitted.

EXAMPLE 3

Figure 12:
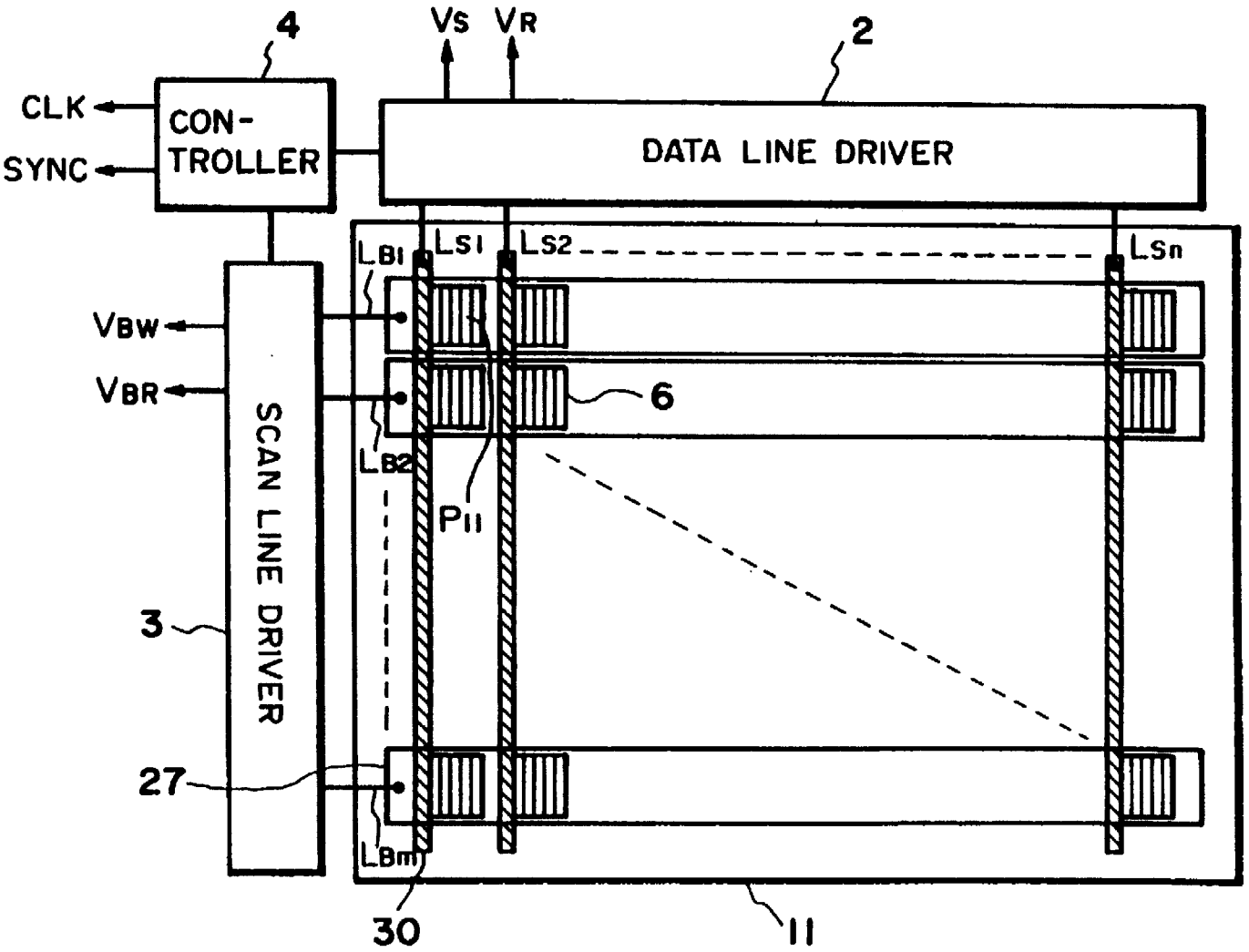
FIG. 12 is an overall plan view of a liquid crystal display apparatus according to a third embodiment of the invention.

FIG. 12 is an overall diagrammatic view of a liquid crystal display apparatus according to a third embodiment of the present invention. The apparatus includes a controller 4 for controlling a scanning line driver 3 and a data line driver 2, by which are respectively driven scanning electrodes 27 ($L_{B1}$–$L_{Bm}$) and data electrodes 30 ($L_{S1}$–$L_{SN}$) in a panel 11. Between the respective data electrodes 30, gradation electrodes 6 are disposed on the same substrate, while scanning electrodes 27 are disposed on a different substrate oppositely disposed with a liquid crystal therebetween. The liquid crystal (similar to those in the previous examples) is driven by voltages between the scanning electrodes 27 and the gradation electrodes 6.

Figure 13A:
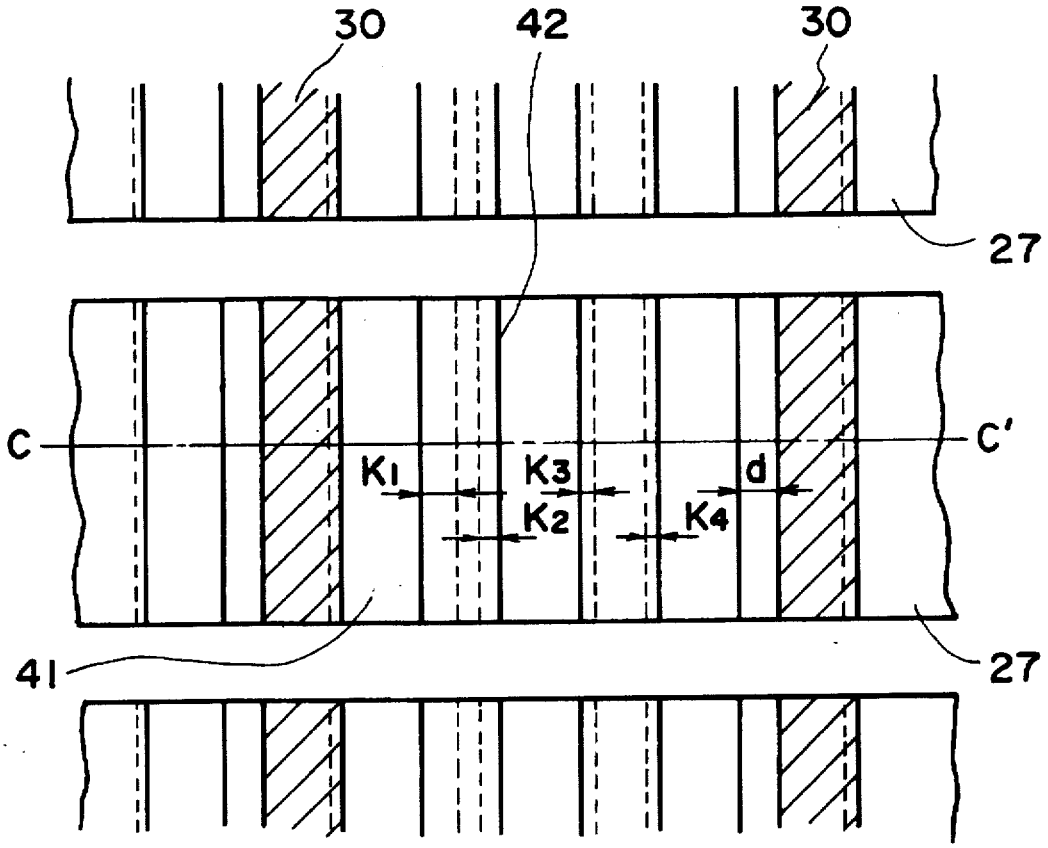
FIGS. 13A and 13B are an enlarged plan view and a sectional view, respectively, of a part corresponding to one pixel in the apparatus shown in FIG. 12.
Figure 13B:
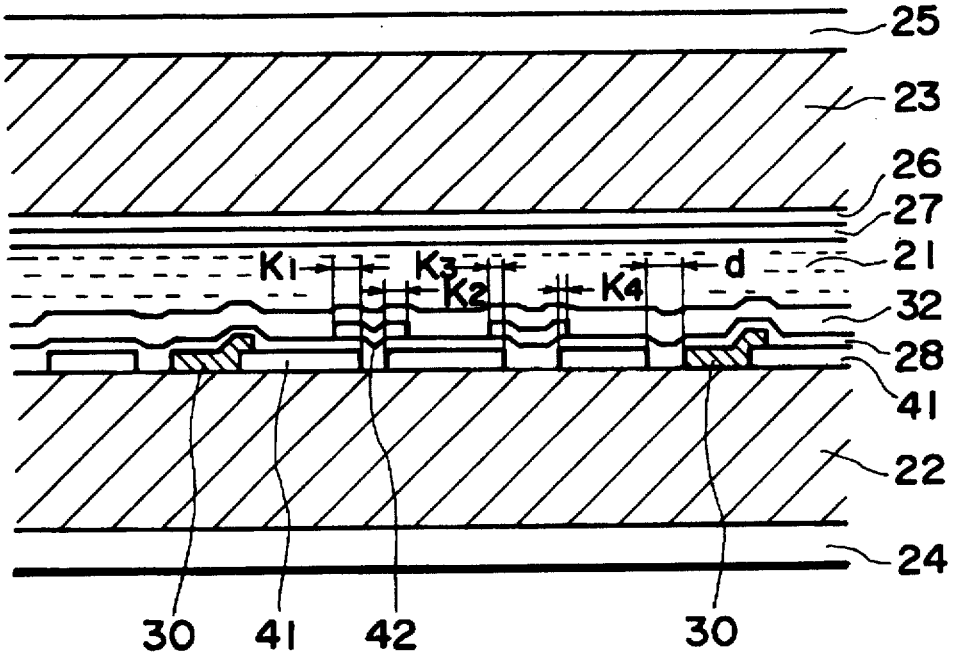

FIG. 13A is an enlarged plan view of a part corresponding to one pixel in the apparatus, and FIG. 13B is a sectional view taken along the line C–C' in FIG. 13A. Referring to these figures, between adjacent data electrodes 30, electrode stripes 41 and 42 constituting gradation electrodes 6 are alternately disposed in a lower layer and in an upper layer, respectively, and in a state of being mutually electrically isolated from each other. Such a panel may be produced in a similar manner as in Example 1. In this embodiment, however, one of the lower gradation electrodes 41 is disposed to electrically and physically contact a data electrode 30, adjacent gradation electrodes 41 and 42 are caused to have mutual overlappings K1–K4 with widths of k1–k4, respectively, satisfying a relationship of k1>k2>k3>k4. One (rightmost one in this embodiment) among a series of gradation electrodes is disposed with a spacing d from a neighboring data electrode 30 so that only a substantially negligible capacitance is formed thereat.

Figure 14:
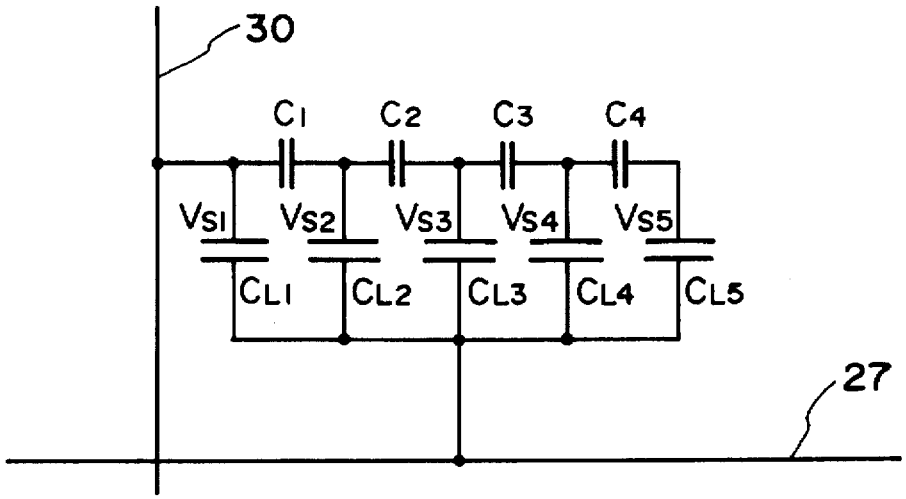
FIG. 14 is an equivalent circuit diagram of a part corresponding to one pixel in the apparatus shown in FIG. 12.

An equivalent circuit of one pixel in this embodiment is represented by FIG. 14, wherein $C_1$–$C_4$ respectively denote a capacitance between adjacent gradation electrodes; $C_{L1}$–$C_{L5}$ respectively denote a capacitance between a gradation electrode and a scanning electrode 27 sandwiching the liquid crystal layer; and $V_{S1}$–$V_{S5}$ respectively denote voltages applied to the respective gradation electrodes.

Figure 15:
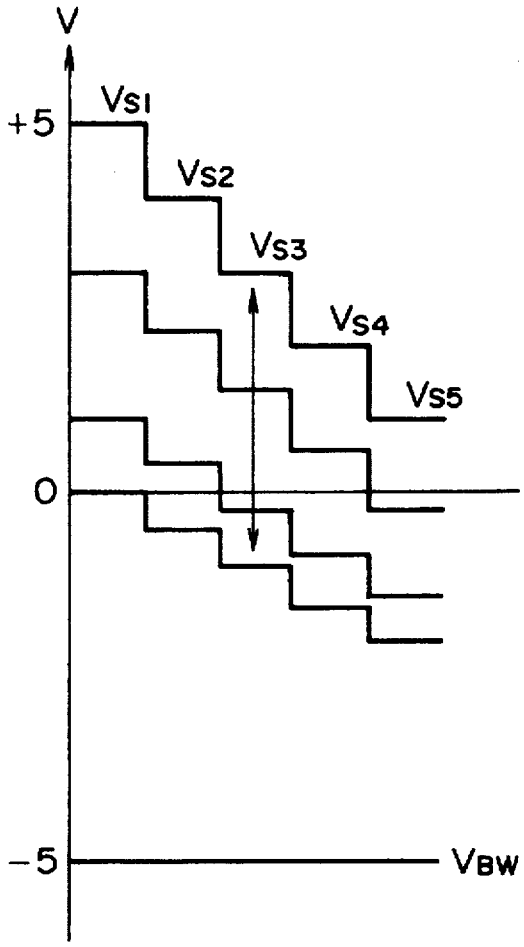
FIG. 15 is diagram showing a voltage distribution provided to the gradation electrodes in a pixel at the time of selection in the apparatus shown in FIG. 12.

FIG. 15 shows a voltage distribution at respective gradation electrodes in a pixel at the time of selection. In this instance, the scanning electrode 27 is supplied with $V_{BW}$, the data electrode 30 is supplied with a data voltage $V_S$ determined by given gradation data, and the voltages of the gradation electrodes are capacitively divided into voltages $V_{S1}$–$V_{S5}$ which vary stepwise as shown in FIG. 15. Herein, the voltage $V_{S1}$ of the leftmost gradation electrode contacting the data electrode 30 is equal to the data voltage $V_S$. Further, the stepwise variations in the voltages $V_{S1}$–$V_{S5}$ are made linear (equally spaced) by optimization of the capacitances $C_1$–$C_4$ shown in the equivalent circuit of FIG. 4. Correspondingly, the overlappings K1–K4 are made mutually different in size as described above. As the level of the data voltage varies depending on given gradation data, the levels of voltages $V_{S1}$–$V_{S5}$ vary as shown in FIG. 15, so that the voltage difference with the scanning electrode voltage $V_{BW}$ varies and the number of gradation electrodes giving voltage differences exceeding the threshold voltage Vth varies, whereby a stepwise voltage-area gradational display is performed at a number of levels (5 in this embodiment) corresponding to the number of gradation electrodes in one pixel.

Figure 16:
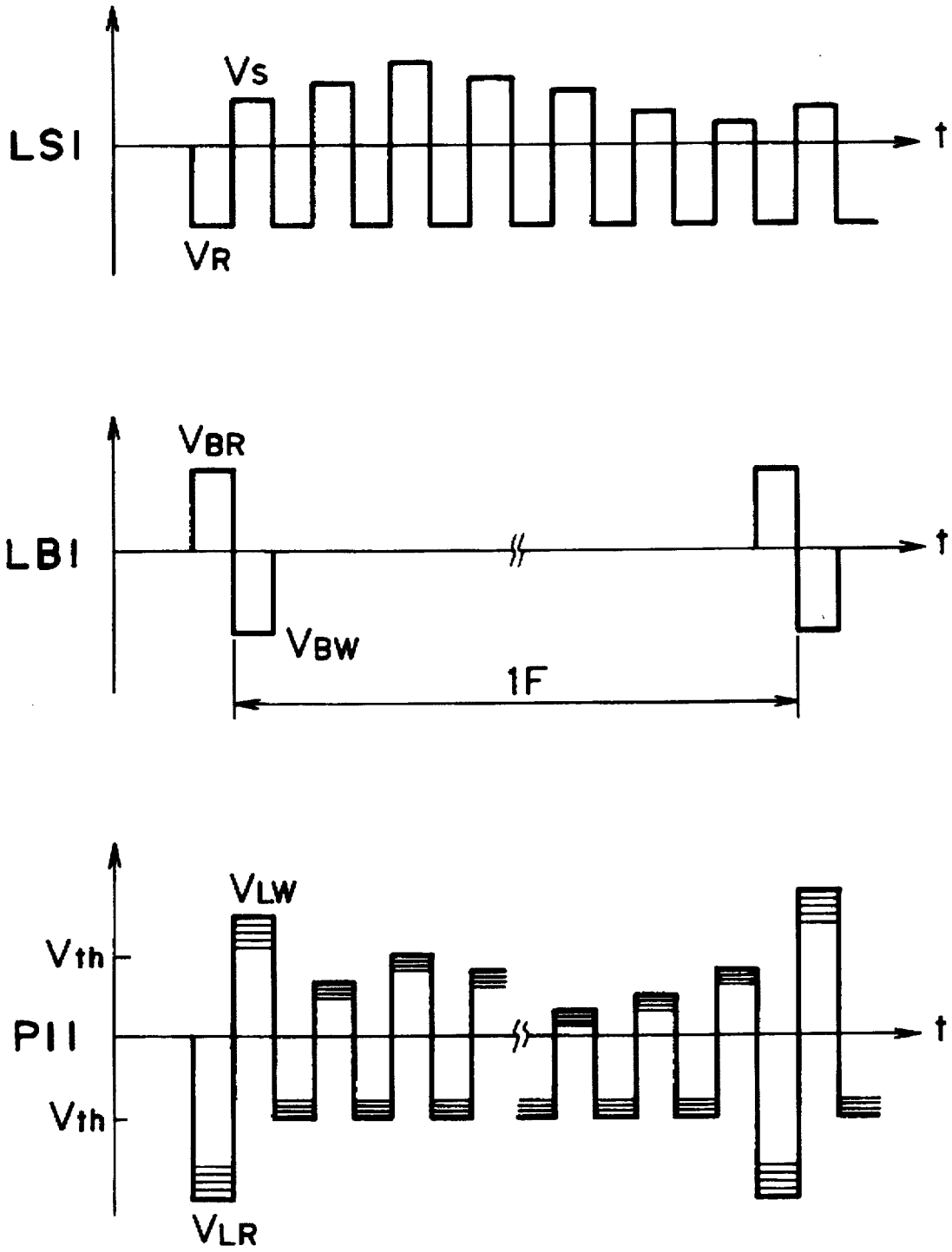
FIG. 16 is a waveform diagram showing voltage waveforms applied to the respective electrodes in the apparatus of FIG. 12.

FIG. 16 shows voltage waveforms LS1 and LB1 applied to a data electrode $L_{S1}$ and a scanning electrode $L_{B1}$, respectively, and a voltage waveform P11 applied to the liquid crystal at a pixel $P_{11}$ (see FIG. 12) disposed at the intersection of the data electrode $L_{S1}$ and the scanning electrode $L_{B1}$. These voltage pulses all have a pulse width of 100 μsec. At a time when a reset voltage pulse $V_R$ of the waveform LS1 and a reset voltage pulse $V_{BR}$ of the waveform LB1 are synchronized, the liquid crystal at the pixel $P_{11}$ is reset by application of a voltage pulse $V_{LR}$ exceeding a threshold Vth. Immediately thereafter, at a time when a data voltage pulse $V_S$ of the waveform LS1 and a writing voltage pulse $V_{BW}$ of the waveform LB1 are synchronized, a voltage pulse $V_{LW}$ corresponding to the above-mentioned voltages $V_{S1}$–$V_{S5}$ is applied to the pixel $P_{11}$ to effect a writing (gradational display). The pixel receives crosstalk voltages until a subsequent resetting and writing after one frame of writing due to application of data voltages to pixels on the other scanning lines, but adverse effects thereof can be obviated by setting these crosstalk voltages to be below the threshold voltage Vth of the liquid crystal.

In this embodiment (Example 3), it is possible to effect a smooth drive of FLC similarly as in Example 1 and also possible to adapt a simpler electrode arrangement and simple driving voltage waveforms applied to the respective electrodes.

EXAMPLE 4

Figure 17:
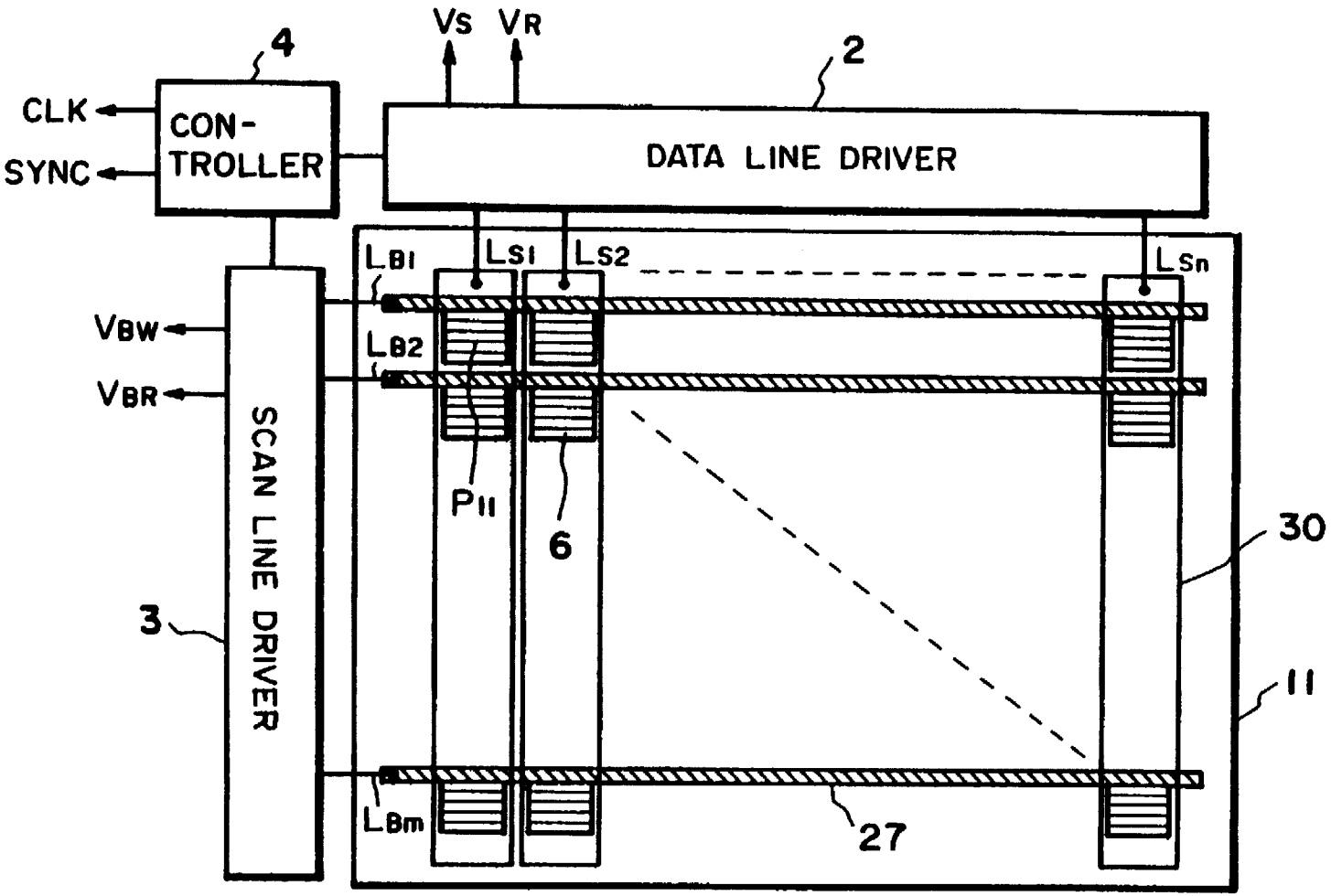
FIG. 17 is an overall plan view of a liquid crystal display apparatus according to a fourth embodiment of the invention.

FIG. 17 is an overall diagrammatic view of a liquid crystal apparatus according to a fourth embodiment of the present invention. Referring to the figure, the apparatus includes a controller 4 for controlling a scanning line driver 3 and a data line driver 2, by which are respectively driven scanning electrodes 27 ($L_{B1}$–$L_{Bm}$) and data electrodes 30 ($L_{S1}$–$L_{SN}$) in a panel 11. Between the respective scanning electrodes 27, gradation electrodes 6 are disposed on the same substrate, while data electrodes 30 are disposed on a different substrate oppositely disposed with a liquid crystal therebetween. The liquid crystal is driven by voltages between the data electrodes 30 and the gradation electrodes 6.

This example is particularly different from Example 3 in that the gradation electrodes are disposed in electrical isolation from each other between the scanning electrodes 27, and the other cell structure and production process are similar to those in Example 1. The liquid crystal may similarly comprise FLC.

Figure 18:
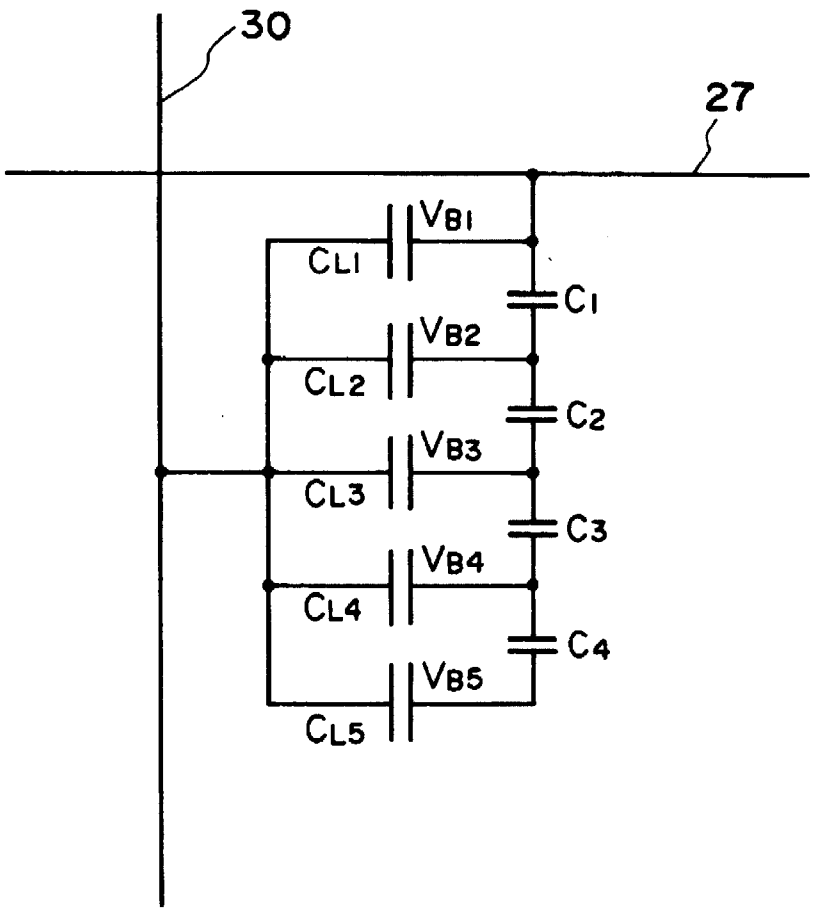
FIG. 18 is an equivalent circuit diagram of a part corresponding to one pixel in the apparatus shown in FIG. 17.
Figure 20A:
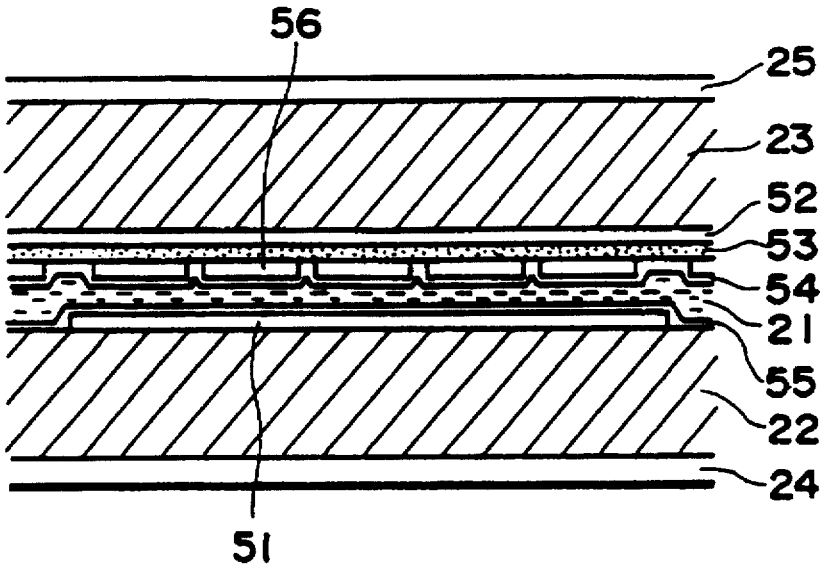
FIG. 20A PRIOR ART
FIG. 20A is a sectional view of a liquid crystal display apparatus of the prior art.
Figure 20B:
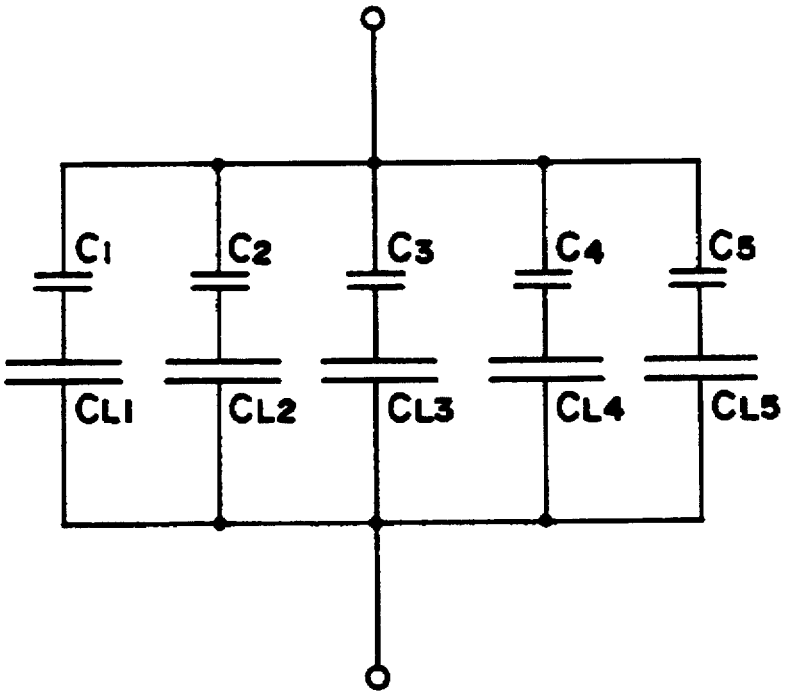
FIG. 20B PRIOR ART
FIG. 20B is an equivalent circuit of one pixel thereof.

An equivalent circuit of one pixel in this embodiment is represented by FIG. 18, wherein $C_1$–$C_4$ respectively denote a capacitance between adjacent gradation electrodes; $C_{L1}$–$C_{L5}$ respectively denote a capacitance between a gradation electrode and a scanning electrode 27 sandwiching the liquid crystal layer; and $V_{B1}$–$V_{B5}$ respectively denote voltages applied to the respective gradation electrodes.

Figure 19:
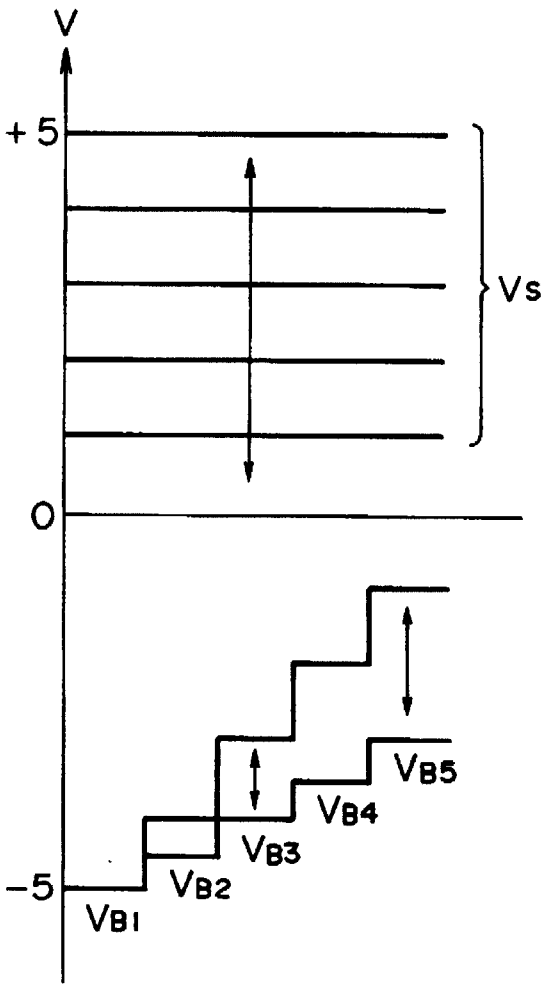
FIG. 19 is a diagram showing a voltage distribution provided to the gradation electrodes in a pixel at the time of selection in the apparatus shown in FIG. 17.

FIG. 19 shows a voltage distribution at respective gradation electrodes in a pixel at the time of selection. In this instance, the scanning electrode 27 is supplied with $V_{BW}$ similarly as in Example 3, and the voltages of the gradation electrodes are capacitively divided into voltages $V_{B1}$–$V_{B5}$ which vary stepwise as shown in FIG. 19.

On the other hand, the data electrode 30 is supplied with a data voltage $V_S$ which varies depending on given gradation data. In this instance, however, the voltages $V_{B1}$–$V_{B5}$ also vary as shown in FIG. 19. As a result, the liquid crystal at the gradation electrodes giving a voltage difference between the data voltage $V_S$ and the gradation electrode voltages $V_{B1}$–$V_{B5}$ exceeding the threshold voltage Vth of the liquid crystal changes its molecular orientation to modulate the optical transmittance, whereby a stepwise voltage-area gradational display is performed at a number of levels (5 in this embodiment) corresponding to the number of gradation electrodes in one pixel similarly as in Example 3. The voltage waveforms and pulse widths applied to the respective electrodes are similar to those in Example 3, and an advantage of a simpler electrode arrangement is also obtained similarly as in Example 3.

As described hereinabove, according to the present invention, it is possible to effect a gradational display utilizing capacitance division by using a liquid crystal having a spontaneous polarization, such as FLC.

What is claimed is:

1. A liquid crystal apparatus, comprising:

a plurality of scanning electrodes and a plurality of data electrodes, wherein the data electrodes are spaced from and disposed opposite to and intersecting the scanning electrodes so as to form a pixel at each intersection of the scanning and data electrodes, said scanning electrodes and said data electrodes respectively being in the form of stripes and extending perpendicular to each other;

a liquid crystal layer disposed between the scanning electrodes and the data electrodes such that a voltage is applied across the liquid crystal layer at each pixel between a pair formed by one of the scanning electrodes and one of the data electrodes;

a plurality of third electrodes disposed at each pixel, wherein the third electrodes are capacitively coupled in series to each other, and wherein one of the third electrodes is capacitively coupled or electrically directly coupled to the associated scanning electrode as to form a plurality of controlled capacitances connected in series, each capacitance being between an adjacent pair of the third electrodes, and so that stepwise different voltages are applied across the liquid crystal layer between the third electrodes and an opposite one of the data electrodes; and a plurality of auxiliary electrodes each disposed between an adjacent pair of the scanning electrodes, wherein a plurality of the third electrodes are disposed between an adjacent pair of a scanning electrode and an auxiliary electrode to receive stepwise different voltages formed by capacitively dividing a potential difference between the scanning electrode and the auxiliary electrode.

2. A liquid crystal apparatus comprising:

a plurality of scanning electrodes and a plurality of data electrodes, wherein the data electrodes are spaced from and disposed opposite to and intersecting the scanning electrodes so as to form a pixel at each intersection of the scanning and data electrodes, said scanning electrodes and said data electrodes respectively being in the form of stripes and extending perpendicular to each other;

a liquid crystal layer disposed between the scanning electrodes and the data electrodes such that a voltage is applied across the liquid crystal layer at each pixel between a pair formed by one of the scanning electrodes and one of the data electrodes;

a plurality of third electrodes disposed at each pixel, wherein the third electrodes are capacitively coupled in series to each other, and wherein one of the third electrodes is capacitively coupled or electrically directly coupled to the associated scanning electrode as to form a plurality of controlled capacitances connected in series, each capacitance being between an adjacent pair of the third electrodes, and so that stepwise different voltages are applied across the liquid crystal layer between the third electrodes and an opposite one of the data electrodes; and a plurality of auxiliary electrodes each disposed between an adjacent pair of the scanning electrodes, wherein a plurality of the third electrodes are disposed between an adjacent pair of a scanning electrode and an auxiliary electrode to receive stepwise different voltages formed by capacitively dividing a potential difference between the scanning electrode and the auxiliary electrode, wherein each adjacent pair of the third electrodes is disposed at different spacings from the liquid crystal layer and the third electrodes constituting respective adjacent pairs partially overlap each other with an insulating film therebetween so as to provide one of the capacitances at an overlapping portion.

3. A liquid crystal apparatus comprising:

a plurality of scanning electrodes and a plurality of data electrodes, wherein the data electrodes are spaced from and disposed opposite to and intersecting the scanning electrodes so as to form a pixel at each intersection of the scanning and data electrodes, said scanning electrodes and said data electrodes respectively being in the form of stripes and extending perpendicular to each other;

a liquid crystal layer disposed between the scanning electrodes and the data electrodes such that a voltage is applied across the liquid crystal layer at each pixel between a pair formed by one of the scanning electrodes and one of the data electrodes;

a plurality of third electrodes disposed at each pixel, wherein the third electrodes are capacitively coupled in series to each other, and wherein one of the third electrodes is capacitively coupled or electrically directly coupled to the associated scanning electrode as to form a plurality of controlled capacitances connected in series, each capacitance being between an adjacent pair of the third electrodes, and so that stepwise different voltages are applied across the liquid crystal layer between the third electrodes and an opposite one of the data electrodes; and a plurality of auxiliary electrodes each disposed between an adjacent pair of the scanning electrodes, wherein a plurality of the third electrodes are disposed between an adjacent pair of a scanning electrode and an auxiliary electrode to receive stepwise different voltages formed by capacitively dividing a potential difference between the scanning electrode and the auxiliary electrode, wherein said plurality of third electrodes are disposed in a same plane with a minute gap between each adjacent pair of the third electrodes, said minute gap determining one of the capacitances between the adjacent pair of third electrodes.

4. An apparatus according to claim 1, 2 or 3, further comprising means for applying a data signal to the scanning electrodes and a scanning signal to the data electrodes.

5. An apparatus according to claim 1, 2 or 3, further comprising means for applying a data signal to the data electrodes and a scanning signal to the scanning electrodes.

6. An apparatus according to claim 1, 2 or 3, wherein an adjacent pair of the third electrodes have a capacitance therebetween which is larger than that formed across the liquid crystal layer between one of the third electrodes and one of the data electrodes opposite thereto with respect to the third electrodes corresponding to one pixel.

7. An apparatus according to claim 1, 2 or 3, wherein adjacent pairs of the third electrodes have mutually different capacitances with respect to the third electrodes corresponding to one pixel.

8. An apparatus according to claim 7, wherein the capacitances between the adjacent pairs of the third electrodes are adjusted so that the voltages applied across the liquid crystal layer between the third electrodes and the data electrode opposite thereto are linearly distributed at the time of writing one pixel.

* * * * *

UNITED STATES PATENT AND TRADEMARK OFFICE

CERTIFICATE OF CORRECTION

PATENT NO. : 5,706,021

DATED : January 6, 1998

INVENTOR(S) : KATSUMI KUREMATSU

It is certified that error appears in the above-identified patent and that said Letters Patent is hereby corrected as shown below:

[57] ABSTRACT

Line 3, "intersecting" should read --overlapping--.
Line 4, "overlapping" should read --intersecting--.

COLUMN 3

Line 16, "over-" should read --(over---.
Line 17, "lapping" should read --lapping)--.

COLUMN 5

Line 51, "In" should read --In the--.

COLUMN 6

Line 28, "unsymmetricity" should read --unsymmetry--.

UNITED STATES PATENT AND TRADEMARK OFFICE

CERTIFICATE OF CORRECTION

PATENT NO. : 5,706,021

DATED : January 6, 1998

INVENTOR(S) : KATSUMI KUREMATSU

It is certified that error appears in the above-identified patent and that said Letters Patent is hereby corrected as shown below:

COLUMN 7

Line 54, "receive" should read --receives--.

Signed and Sealed this

Fifteenth Day of September, 1998

Bruce Lehman

*Attest:*

BRUCE LEHMAN

*Attesting Officer*

*Commissioner of Patents and Trademarks*